United States Patent [19]

Yagihara et al.

[11] Patent Number: 5,006,445

[45] **Date of Patent: * Apr. 9, 1991**

[54] SILVER HALIDE PHOTOGRAPHIC MATERIAL

[75] Inventors: Morio Yagihara; Hisashi Okada; Kazunobu Katoh, all of Kanagawa, Japan

[73] Assignee: Fuji Photo Film Co., Ltd., Kanagawa, Japan

[ * ] Notice: The portion of the term of this patent subsequent to Nov. 20, 2007 has been disclaimed.

[21] Appl. No.: 343,441

[22] Filed: Apr. 26, 1989

[30] Foreign Application Priority Data

Apr. 28, 1988 [JP] Japan ..... 63-105682

[51] Int. Cl.[5] ..... G03C 1/08; G03C 1/34

[52] U.S. Cl. ..... 430/264; 430/598

[58] Field of Search ..... 430/264, 598

[56] References Cited

U.S. PATENT DOCUMENTS

| | | | |
|---|---|---|---|
| 4,737,452 | 4/1988 | Kameoka et al. | 430/600 |
| 4,798,780 | 1/1989 | Hall et al. | 430/264 |
| 4,824,764 | 4/1989 | Inagaki et al. | 430/264 |
| 4,847,180 | 7/1989 | Miyata et al. | 430/264 |

FOREIGN PATENT DOCUMENTS

| | | | |
|---|---|---|---|
| 0286062 | 10/1988 | European Pat. Off. | 430/598 |
| 0286840 | 10/1988 | European Pat. Off. | 430/598 |

*Primary Examiner*—Charles L. Bowers, Jr.
*Assistant Examiner*—Janet C. Baxter
*Attorney, Agent, or Firm*—Burns, Doane, Swecker & Mathis

[57] ABSTRACT

A silver halide photographic material comprising a support having thereon at least one hydrophilic colloid layer, at least one of which is a silver halide photographic emulsion layer, is disclosed. At least one of the silver halide emulsion layers or other hydrophilic colloid layers of the photographic material contains a compound represented by formula (I):

(I)

wherein, $A_1$ and $A_2$ both represent hydrogen atoms or one represents a hydrogen atom and the other a sulfonyl group or an acyl group, $R_1$ represents an aliphatic group, an aromatic group or a heterocyclic group, $G_1$ represents a carbonyl group, a sulfonyl group, a sulfoxy group, a group wherein $R_2$ represents an alkoxy group or an aryloxy group, a group or an iminomethylene group, $X_1$ is a moiety which instigates a ring-forming reaction by cleaving the $—G_1—X_1$ moiety from the residual molecule and forms a cyclic structure containing the atoms of the $—G_1—X_1$ moiety, and at least one of $R_1$ and $X_1$ has a silver halide adsorption accelerating group.

12 Claims, No Drawings

SILVER HALIDE PHOTOGRAPHIC MATERIAL

FIELD OF THE INVENTION

The present invention relates to a silver halide photographic material which provides a negative image having extremely high contrast, high sensitivity and excellent halftone quality, and a silver halide photographic material which provides a direct positive photographic image. More particularly, the present invention relates to a photographic light-sensitive material which includes a novel silver halide nucleating agent.

BACKGROUND OF THE INVENTION

U.S. Pat. No. 3,730,727 (developing solutions comprising a combination of ascorbic acid and hydrazine), U.S. Pat. No. 3,227,552 (use of hydrazine as a auxiliary developing agent for providing a direct positive color image), U.S. Pat. No. 3,386,831 (use of $\beta$-monophenylhydrazide of aliphatic carboxylic acid as a stabilizer for silver halide light-sensitive materials), U.S. Pat. No. 2,419,975, and Mees, *The Theory of Photographic Process,* 3rd ed., 1966, page 281, disclose the use hydrazine compounds in a silver halide photographic emulsions or developing solutions.

In particular, it is disclosed in U.S. Pat. No. 2,419,975 that a high contrast negative image can be obtained by the incorporation of a hydrazine compound.

The patent disclose that when a light-sensitive material comprising a silver bromochloride emulsion containing a hydrazine compound incorporated therein is developed with a developing solution having a high pH value such as 12.8, an extremely high contrast having a gamma value of more than 10 can be provided. However, strongly alkaline developing solutions having pH values of near 13 are susceptible to air oxidation and are unstable, they are therefore, unsuitable for prolonged use or storage.

An ultra-high contrast wherein a gamma value is more than 10 is extremely useful for the photographic reproduction of continuous tone images or the reproduction of line images by dot image processing which is useful for photo-engraving making regardless of whether negative images or positive images are formed. For this purpose, a light-sensitive material comprising a silver bromochloride photographic emulsion having a silver chloride content of 50 mol % or more and preferably 75 mol % or more, has been developed with a hydroquinone developing solution having an extremely low effective concentration of sulfinic ion (normally 0.1 mol/l or less). However, because of its low sulfinic ion concentration, such a developing solution is extremely unstable and defies prolonged storage (e.g. more than 3 days).

Furthermore, these methods require the use of a silver bromochloride emulsion having a rather high silver chloride content and thus cannot provide high sensitivity. It has, therefore, been desired to obtain ultra-high contrast useful for reproduction of dot images or line images using a high sensitivity emulsion and a stable developing solution.

The Inventors have disclosed a silver halide photographic emulsion which is developed with a stable developing solution to provide an extremely high contrast (see U.S. Pat. Nos. 4,224,401, 4,168,977, 4,243,739, 4,272,614 and 4,323,643). However, it has been found that the acyl hydrazine compounds used in these emulsions have some disadvantages.

For example, the hydrazines have been known to produce nitrogen gas during development. The nitrogen gas forms bubbles in the film which damage photographic images. Furthermore, the nitrogen gas flows into the developing solution, adversely affecting other photographic light-sensitive materials.

Furthermore, these hydrazines are disadvantageous in that they need to be used in a large amounts to provide sensitization and higher contrast. These hydrazines are also disadvantageous in that when they are used in combination with other sensitizing techniques (e.g., to increase chemical sensitization, increase grain size, sensitization accelerating compounds as described in U.S. Pat. Nos. 4,272,606, and 4,241,164 may be added) to render the light-sensitive material more sensitive, sensitization and/or fogging may occur during the storage of the light-sensitive material.

Therefore, it would be beneficial to provide a compound which can reduce bubble production and the flow of bubbles into the developing solution, which causes no stability problems with time, and can be used in extremely small amounts to provide high contrast.

U.S. Pat. Nos. 4,385,108, 4,269,929 and 4,243,739 indicate that hydrazines containing substituents which are easily adsorbed by silver halide grains can be used to obtain extremely high contrast negative gradation. Among hydrazine compounds containing such adsorption groups, the specific examples described above are disadvantageous in that they ar subject to desensitization with time upon storage.

On the other hand, there are various direct positive photographic processes. Among these processes, the most useful are processes in which silver halide grains are exposed to light in the presence of a desensitizer, and then developed, and processes in which silver halide emulsions containing light-sensitive nuclei primarily within the silver halide grains are exposed to light, and then developed in the presence of a nucleating agent. The present invention relates to the latter type of process. A silver halide emulsion containing light-sensitive nuclei primarily within the silver halide grains which forms latent images therein is commonly referred to as an internal latent image type silver halide emulsion. This type of emulsion is distinguished from silver halide emulsions which form latent images primarily on the surface of silver halide grains.

There are known processes in which internal latent image-type silver halide photographic emulsions are surface-developed in the presence of a nucleating agent to provide direct positive images, as well as photographic emulsions or light-sensitive materials for use in such processes.

In the above described processes for the formation of direct positive images, nucleating agents have been incorporated in the developing solution. Also nucleating agents have been incorporated in the photographic emulsion layer or other proper layers in light-sensitive materials so that when it is absorbed by the surface of silver halide grains, better reversal properties can be obtained.

Examples of such nucleating agents include hydrazines such as those described in U.S. Pat. Nos. 2,563,785 and 2,588,982, hydrazide and hydrazine compounds such as those described in U.S. Pat. No. 3,227,552, heterocyclic quaternary salt compounds such as those described in U.S. Pat. Nos. 3,615,615, 3,719,494, 3,734,738, 4,094,683 and 4,115,122, British Patent 1,283,835, and JP-A-52-3426, and JP-A-52-69613 (The term "JP-A" as used herein means an "unexamined published Japanese patent application"), thiourea-bond acylphenylhydrazine compounds such as those described in U.S. Pat. Nos. 4,030,925, 4,031,127, 4,139,387, 4,245,037, 4,255,511 and 4,276,364 and British Patent No. 2,012,443, compounds containing as adsorption groups heterocyclic thioamido such as those described in U.S. Pat. No. 4,080,207, phenylacylhydrazine compounds containing heterocyclic groups comprising mercapto groups as adsorption groups such as those described in British Patent 2,011,397B, sensitizing dyes containing in the molecular structure thereof substituents having a nucleating effect such as those described in U.S. Pat. No. 3,718,470 and hydrazine compounds such as those described in JP-A-59-200230, JP-A-59-212828 and JP-A-59-212829 and Research Disclosure No. 23,510 (January, 1953).

However, these compounds have been found disadvantageous in that they provide insufficient activity as nucleating agents. Even when they provide sufficient activity, their preservability has been found to be insufficient. Their activity may be deteriorated by the time when it is coated on a support in the form of an emulsion. If they are used in large amounts, they deteriorate the properties of the prepared film.

In order to overcome these disadvantages, some compounds have been proposed such as the adsorption-type hydrazine derivatives described in JP-A-60-179734, JP-A-61-170733, JP-A-62-65034, JP-A-61-270744 and JP-A-62- 948, and the hydrazine derivatives containing modified groups described in JP-A-62-270948, and JP-A-63-29751. However, none of these compounds have exhibited sufficient nucleation activity to meet the demands for improving stability of the developing solution (i.e., preventing deterioration of the developing agent) by lowering the pH value of the processing solution, shortening processing time, and/or reducing the dependence of the change in the composition of the developing solution (e.g., pH, sodium sulfite).

SUMMARY OF THE INVENTION

Accordingly, it is an object of the present invention to provide a silver halide photographic material which can provide an extremely high contrast negative gradation having a gamma value of more than 10 using a stable developing solution.

It is another object of the present invention to provide a negative type silver halide photographic material containing high activity hydrazines which can be used in a small amounts to provide a high contrast negative gradation using a low pH developing solution (i.e., pH value of not more than 11.0, preferably 9.5 to 11.0) without adversely affecting photographic properties.

It is further object of the present invention to provide a direct positive-type silver halide photographic material containing high activity hydrazines which can provide excellent reversal properties using a low pH developing solution.

It is still further object of the present invention to provide a silver halide photographic material with excellent aging stability containing hydrazines which can be easily synthesized and have excellent preservability.

It is additional object of the present invention to provide a silver halide photographic material containing an emulsion having excellent aging stability and which varies little in activity during preparation.

The above objects of the invention may be accomplished with a silver halide photographic material comprising a support having thereon at least one hydrophilic colloid layer, at least one of which is a silver halide photographic emulsion layer, wherein at least one of the silver halide emulsion layers or other hydrophilic colloid layers contains a compound represented by formula (I):

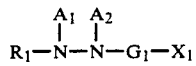

(I)

wherein, $A_1$ and $A_2$ both represent hydrogen atoms or one represents a hydrogen atom and the other a sulfonyl group or an acyl group, $R_1$ represents an aliphatic group, an aromatic group or a heterocyclic group, $G_1$ represents a carbonyl group, a sulfonyl group, a sulfoxy group, a

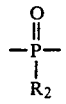

group wherein $R_2$ represents an alkoxy group or an aryloxy group, a

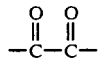

group or an iminomethylene group, $X_1$ is a moiety which instigates a ring-forming reaction by cleaving the $—G_1—X_1$ moiety from the residual molecule and forms a cyclic structure containing the atoms of the $—G_1—X_1$ moiety, and at least one of $R_1$ and $X_1$ has a silver halide adsorption accelerating group.

DETAILED DESCRIPTION OF THE INVENTION

In formula (I), $A_1$ and $A_2$ are preferably hydrogen atoms, alkylsulfonyl or arylsulfonyl groups having not more than 20 carbon atoms (more preferably a phenylsulfonyl group or a phenylsulfonyl group substituted in such a way that the sum of the Hammett substituent group constants is −0.5 or more), or straight-chain, branched-chain or cyclic unsubstituted or substituted aliphatic acyl groups (e.g., halogen atoms, ether groups, sulfonamido groups, carbonamido groups, hydroxyl groups, carboxyl groups and sulfonic acid groups). It is most preferable that $A_1$ and $A_2$ are both hydrogen atoms.

When $R_1$ is an aliphatic groups, it is preferred to be a straight-chain, branched-chain or cyclic alkyl, alkenyl or alkynyl groups, and preferably has 1 to 30 carbon atoms, and more preferably, 1 to 20 carbon atoms. In this regard, the branched-chain alkyl groups may be formed into rings in such a way as to form saturated hetero rings containing one or more hetero atoms within them. Examples include the methyl group, t-butyl group, n-octyl group, t-octyl group, cyclohexyl group, hexenyl group, pyrrolidyl group, tetrahydrofuryl group and n-dodecyl group.

If $R_1$ is an aromatic group, it is preferable that it be a monocyclic or dicyclic aryl groups. Examples of such include phenyl groups and naphthyl groups.

If $R_1$ is a heterocyclic group, it is preferred to be selected from among 3- to 10-membered saturated or unsaturated heterocyclic groups containing at least one N, O or S atom, and these may be single ringed, and furthermore, they may form condensed rings with other aromatic rings or hetero rings 5- to 6-membered aromatic hetero rings are preferred as the hetero rings. Examples include pyridine rings, imidazolyl groups, quinolinyl groups, benzoimidazolyl groups, pyrimidyl groups, pyrazolyl groups, isoquinolinyl groups, benzothiazolyl groups and thiazolyl groups.

$R_1$ may be substituted by substituent groups. The following examples may be cited as substituent groups. These groups may even be further substituted. Such groups include alkyl groups, aralkyl groups, alkoxy groups, aryl groups, substituted amino groups, acylamino groups, sulfonylamino groups, ureido groups, urethane groups, aryloxy groups, sulfamoyl groups, carbamoyl groups, aryl groups, alkylthio groups, arylthio groups, sulfonyl groups, sulfinyl groups, hydroxyl groups, halogen atoms, cyano groups, sulfo groups and carboxyl groups.

Where possible, the aforementioned groups may link together to form rings.

Of the above, aromatic groups are preferred for $R_1$, with aryl groups being particularly preferred.

As noted above, $G_1$ represents a carbonyl group, a sulfonyl group, a sulfoxy group, a

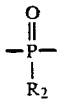

group with $R_2$ representing an alkoxy group or an aryloxy group, a

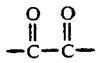

group or an iminomethylene group. Also, $X_1$ is a moiety which instigates a ring-forming reaction and specifically, $X_1$ is a group represented by general formula (a):

$$-L_1-Z_1 \qquad \text{(a)}$$

In the formula, $Z_1$ is a group which is able to cleave the moiety $G_1-L_1-Z_1$ from the residual molecule by attacking $G_1$ nucleophilically, and $L_1$ is a divalent organic group whereby $G_1$, $L_1$, and $Z_1$ are able to form a ring structure when $Z_1$ attacks $G_1$ nucleophilically. In particular, $Z_1$ is a group which, when a hydrazine compound of general formula (I) has produced the following reaction intermediate due to oxidation or the like, readily attacks nucleophilically $$R_1-N=N-G_1-L_1-Z_1$$

and is able to cleave the $R_1-N=N$ group from $G_1$. Specifically, it may be a functional group which reacts directly with $G_1$ such as OH, SH, or $NHR_3$ wherein $R_3$ is a hydrogen atom, an alkyl group (preferably having 1 to 30 carbon atoms), an aryl group, (preferably having 6 to 30 carbon atoms), a heterocyclic group, a $-COR_4$ group or a $-SO_2R_4$ group ($R_4$ being a hydrogen atom, an alkyl group, preferably having 1 to 30 carbon atoms, an aryl group, preferably having 6 to 30 carbon atoms, a heterocyclic group or the like) or COOH. In this regard, the OH, SH, $NHR_3$ and COOH may be temporarily stored in such a way as to produce these groups by means of alkali hydrolysis or the like. Alternatively, it may be a functional group such as

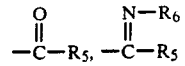

wherein $R_5$ and $R_6$ represent a hydrogen atom, an alkyl group (preferably having 1 to 30 carbon atoms), an alkenyl group (preferably having 2 to 30 carbon atoms), an aryl group (preferably having 6 to 30 carbon atoms) or a heterocyclic group. This functional group reacts with $G_1$ by reacting with nucleophilic agents such as hydroxyl ions and sulfite ions.

The divalent organic group represented by $L_1$ is an atom or atomic group including at least one of C, N, S or O. Specifically, it is, for example, an alkylene group (preferably having 1 to 12 carbon atoms), an alkenylene group (preferably having 2 to 12 carbon atoms), an alkynylene group (preferably having 2 to 12 carbon atoms), an arylene group (preferably having 6 to 12 carbon atoms), a heteroarylene group (preferably having 1 to 12 carbon atoms) which may or may not have substituent groups, —O—, —S—,

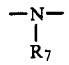

wherein $R_7$ represents a hydrogen atom, alkyl group (preferably having 1 to 12 carbon atoms) or aryl group (preferably having 6 to 12 carbon atoms), —N=, —CO—, $-SO_2-$ and the like, either singly or as a combination thereof. Preferably the ring formed from $G_1$, $Z_1$ and $L_1$ is 5-membered or 6-membered.

Of the substances which are represented by general formula (a), those which can be represented by general formula (b) and general formula (c) below are preferred.

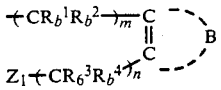

(b)

In the above formula, $R_b^1$ to $R_b^4$ represent hydrogen atoms, alkyl groups, preferably with 1 to 12 carbon atoms, alkenyl groups, preferably with 1 to 12 carbon atoms, aryl groups preferably with from 6 to 12 carbon atoms, and the like and may be identical or different. B is the atom which is required to complete a 5-membered ring or 6-membered ring and may have substituent groups; m and n are 0 or 1 with the proviso that (n+m) is 0 or 1 when $Z_1$ is COOH and is 1 or 2 when $Z_1$ is OH, SH or $NHR_3$.

The 5-membered or 6-membered ring formed by B is, for example, a cyclohexene ring, a cycloheptene ring, a benzene ring, a naphthalene ring, a pyridine ring, a quinoline ring or the like, and $Z_1$ has the same significance as in general formula (a).

In general formula (b), it is preferred that m=0 and n=1 and it is particularly preferred that the ring formed by B is a benzene ring.

$$-(N^{R_c^3})_p-(CR_c^1R_c^2)_q-Z_1 \quad (c)$$

In the formula, $R_c^1$ and $R_c^2$ represent hydrogen atoms, alkyl groups (preferably having 1 to 12 carbon atoms), alkenyl groups (preferably having 2 to 12 carbon atoms), aryl groups (preferably having 6 to 12 carbon atoms), halogen atoms and the like, and may be identical or different. $R_c^3$ represents a hydrogen atom, alkyl group, alkenyl group or aryl group. p represents 0 or 1 and q represents an integer of from 1 to 4.

$R_c^1$, $R_c^2$ and $R_c^3$ may bond together to form a ring provided that it is of a structure where $Z_1$ can affect an intermolecular nucleophilic attack on $G_1$.

$R_c^1$ and $R_c^2$ are preferably hydrogen atoms, halogen atoms or alkyl groups, and $R_c^3$ is preferably an alkyl group or aryl group. q preferably represents 1, 2 or 3; when q is 1, p represents 1 or 2, when q is 2, p represents 0 or 1 and when q is 3, p represents 0 or 1. When q is 2 or 3, plural $CR_c^1R_c^2$ may be identical or different. $Z_1$ has the same significance as in general formula (a).

Adsorption accelerating groups for silver halide which can be substituted by $R_1$ or $X_1$ can be represented by $Y_1-(L_2)_l$, with $Y_1$ being an absorption accelerating group for silver halides and $L_2$ being a divalent linking group. 1 is 0 or 1.

Preferred examples of the adsorption accelerating groups for silver halides represented by $Y_1$ include, for example, thioamido groups, mercapto groups, disulfido bond-containing groups or 5- or 6-membered nitrogen-containing heterocyclic groups.

The thioamido adsorption accelerating groups represented by $Y_1$ may be divalent groups which can be represented by $$-\overset{S}{\overset{\|}{C}}\text{-amino-},$$

they may be part of a ring structure or they may be noncyclic thioamido groups. Useful thioamido adsorption accelerating groups can be chosen from the substances disclosed in U.S. Pat. Nos. 4,030,925 4,031,127, 4,080,207, 4,245,037, 4,255,511, 4,266,013 and 4,276,364 as well as in *Research Disclosure*, Vol. 151, No. 15162 (November, 1976) and *Research Disclosure*, Vol. 176, No. 17626 (December, 1978).

Specific examples of noncyclic thioamido groups include, for example, thioureido groups, thiourethane groups, dithiocarbamic acid esters and the like. Specific examples of ring-like thioamido groups include, for example, 4-thiazoline-2-thione, 4-imidazoline-2-thione, 2thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione, which may or may not be further substituted. Substituent groups include the substances mentioned as substituent groups for $R_1$.

The mercapto groups for $Y_1$ may be aliphatic mercapto groups, aromatic mercapto groups and heterocyclic mercapto groups. In this record, when there is a nitrogen atom next to the carbon atom to which a —SH group is bonded, this has the same significance as the tautomerically related ring-like thioamido group and specific examples of this group are the same as those set forth above.

The disulfido bond-containing group for $X_1$ may be a group having 20 or less carbon atoms and preferably is a group containing a disulfido bond forming a part of 4- to 12-membered ring. Specifically, those as described in JP-A-61-170733 may be applied for the present invention. Specific examples of the disulfido bond-containing group are set forth below.

$C_2H_5$—S—S—,

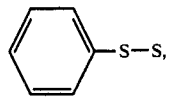

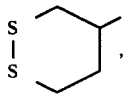

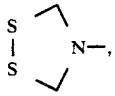

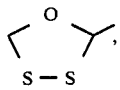

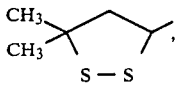

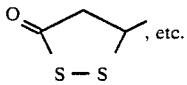 , etc.

The 5-membered or 6-membered nitrogen-containing heterocyclic group represented by $Y_1$ may be 5-membered or 6-membered nitrogen-containing heterocyclic groups formed from a combination of nitrogen, oxygen, sulfur and carbon. Preferred substances for these include benzotriazole, triazole, tetrazole, indazole, benzimidazole, imidazole, benzothiazole, thiazole, benzooxazole, oxazole, thiadiazole, oxadiazole, triazine and the like. They may be further substituted by appropriate substituent groups.

Substituent groups include the substances mentioned as substituent groups for $R_1$. Preferred substances for those represented by $Y_1$ are ring-like thioamido groups (i.e., mercapto-substituted nitrogen-containing heterocyclic groups such as 2-mercaptothiadiazole, 3-mercapto-1,2,4-triazole, 5-mercaptotetrazole, 2-mercapto-1,3,4-oxadiazole, 2-mercaptobenzoxazole), or nitrogen-containing heterocyclic groups (e.g., benzotriazole, benzimidazole and indazole). Furthermore, $Y_1-(L_2)_l$, may be substituted by 2 or more groups which may be identical or different.

The divalent linking group represented by $L_2$ is an atom or atomic group containing at least one of C, N, S and O. Specifically, it may be an alkylene group, alkenylene group, alkynylene group, arylene group, —O—, —S—, —NH—, —N=, —CO—, —$SO_2$—(and these groups may have substituent groups) or the like, either individually or in combination.

Specific examples include —CONH—, —NHCONH—, —$SO_2NH$—, —COO—, —NHCOO—,

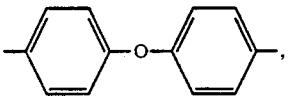

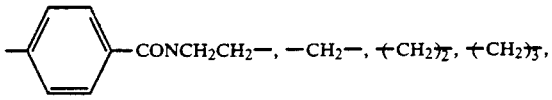

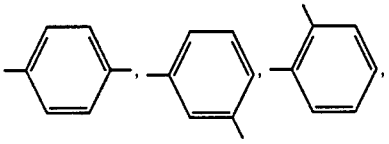

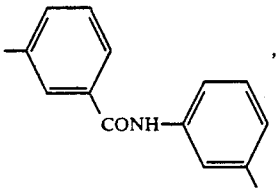

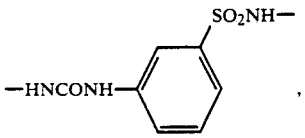

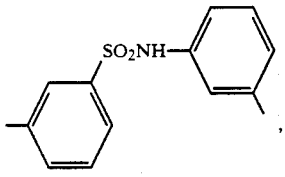

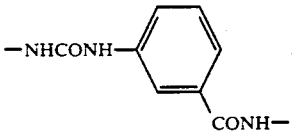

, NHCONHCH$_2$CH$_2$CONH—,

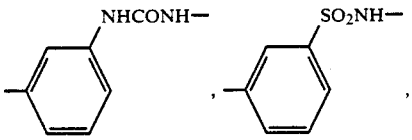

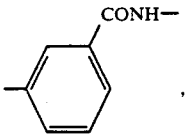

, —CH$_2$CH$_2$$SO_2$NH—,

—CH$_2$CH$_2$CONH—.

The above groups may be further substituted by suitable substituent groups. The substituent groups include those substances mentioned as substituent groups for $R_1$.

Some preferred substances for those which can be represented by general formula (I) are represented by general formula (II).

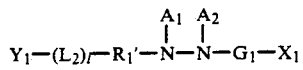

(II)

In the formula, $R_1'$ is a group from which one of the hydrogen atoms of $R_1$ in general formula (I) has been excluded, at least one of $R_1'$ and $L_2$ is a substituent group which can be dissociated to an anion of a pKa of 6 or greater, and preferably can be dissociated to an anion of pKa 8 to 13. It may be a group which dissociates adequately in alkaline solutions (preferably at a pH of 10.5 to 12.3) such as developing solutions but which shows little dissociation in neutral or slightly acidic media. Examples include the hydroxyl group, —$SO_2NH$—, hydroxyimino group (>C=N—OH), active methylene, or an active methine group such as —CH$_2$COO—, —CH$_2$CO—,

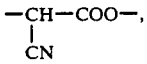

and the like.

$A_1$,$A_2$, $G_1$, $X_1$, $Y_1$, $L_2$ and l have the same significance as explained for general formula (I) and for the adsorption accelerating group for silver halides.

Of the substances represented by general formula (I), those which are represented by general formula (III) below are particularly preferred.

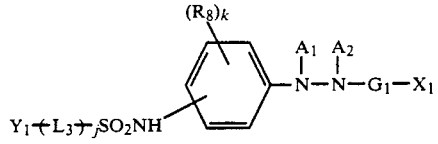

(III)

In the formula, $R_8$ has the same significance as the substances identified as suitable substituent groups for $R_1$ in general formula (I) , k represents 0, 1 or 2, $L_3$ has the same significance as $L_2$ in general formula (II) and j represents 0 or 1. When k is 2, two $R_8$ groups may be identical or different.

$A_1$, $A_2$, $G_1$, $X_1$ and $Y_1$ have the same significance as for the substances cited in general formula (I) and general formula (II).

More preferable are substances in which the $Y_1$—$L_3$—$_j$$SO_2NH$ group has been substituted in the o-position or p-position with respect to the hydrazino group.

Specific examples of the compounds represented by general formula (I) are given below. However, the present invention is not limited to the compounds below.

(I-1)
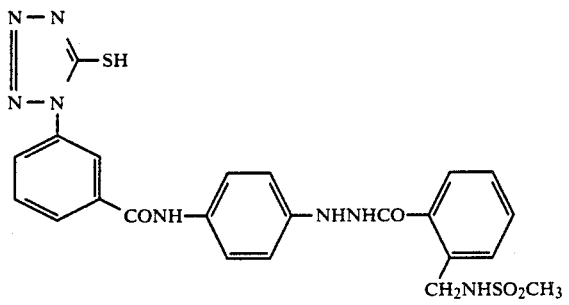
(I-2)
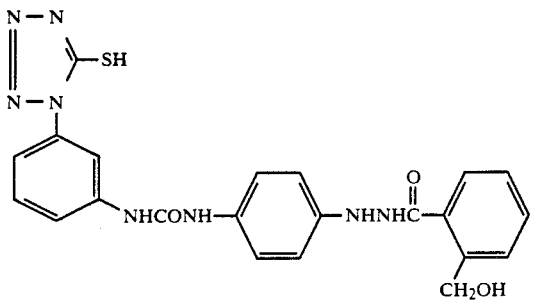
(I-3)
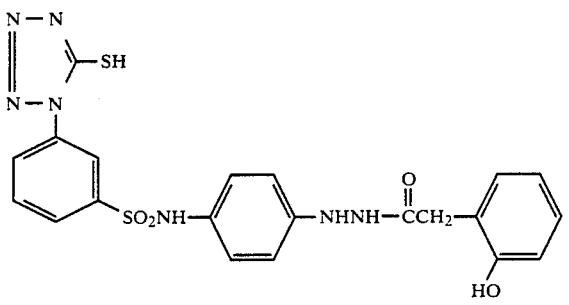
(I-4)
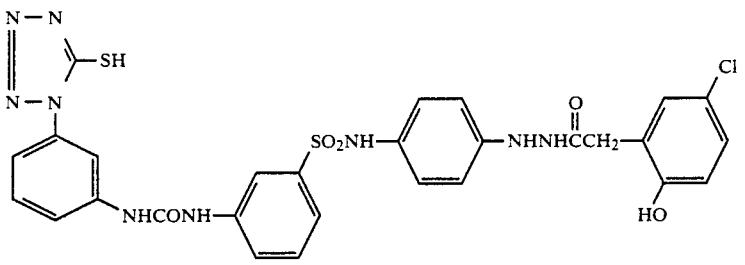
(I-5)
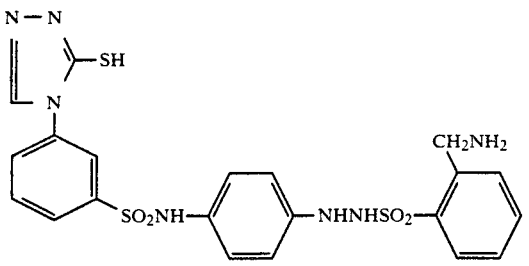

-continued
(I-6)
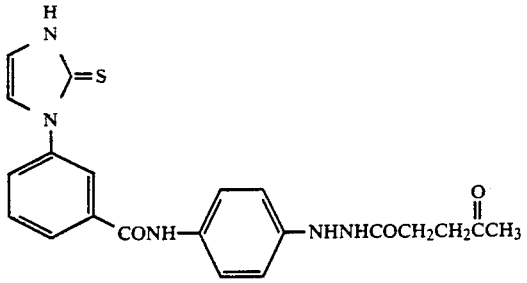
(I-7)
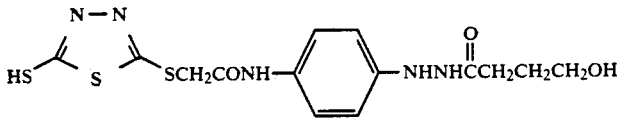
(I-8)
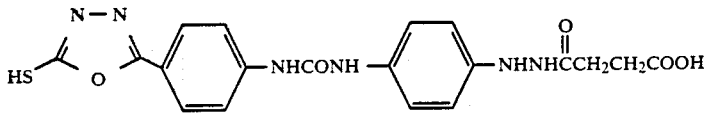
(I-9)
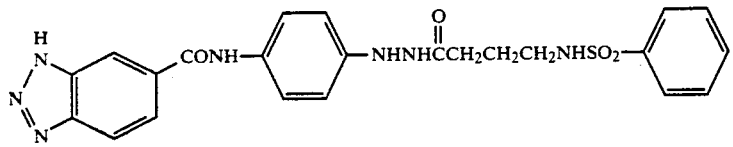
(I-10)
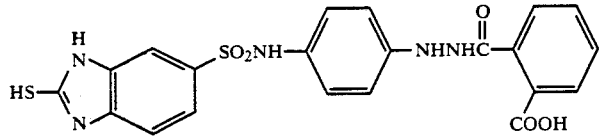
(I-11)
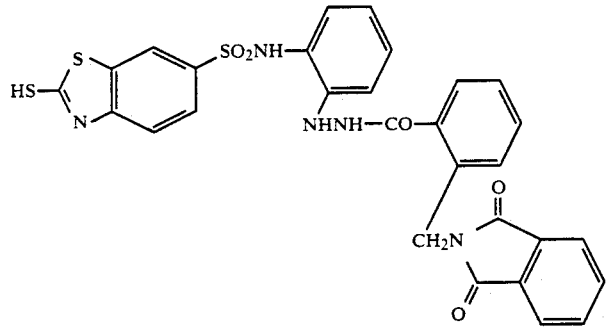
(I-12)
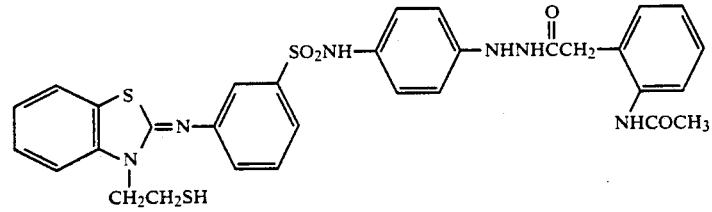
(I-13)
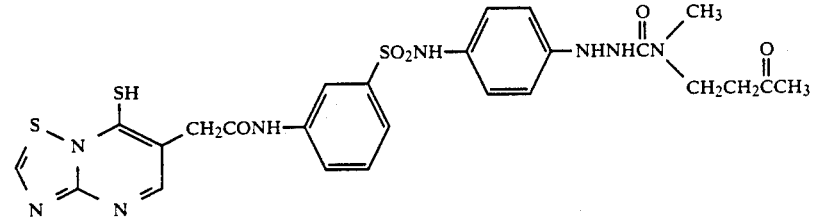

-continued
(I-14)
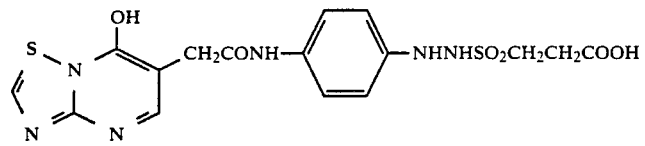
(I-15)
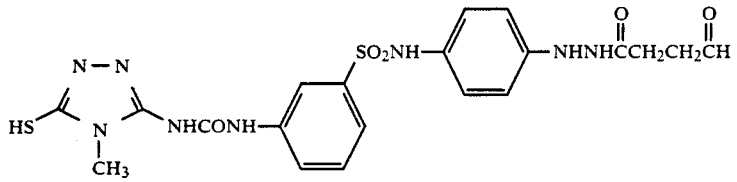
(I-16)
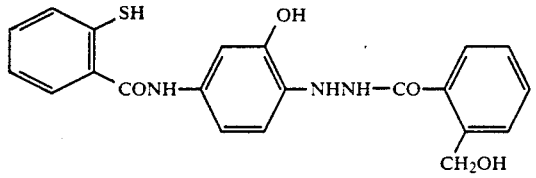
(I-17)
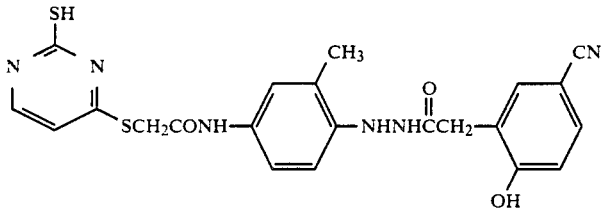
(I-18)
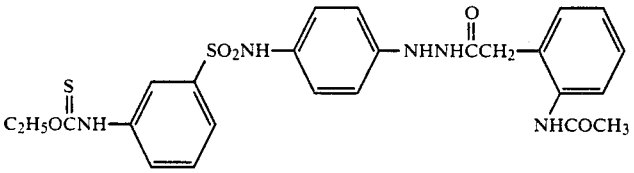
(I-19)
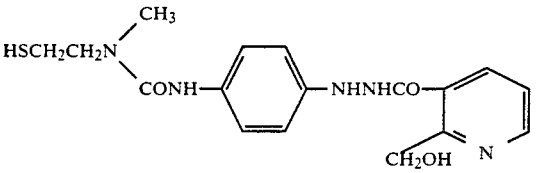
(I-20)
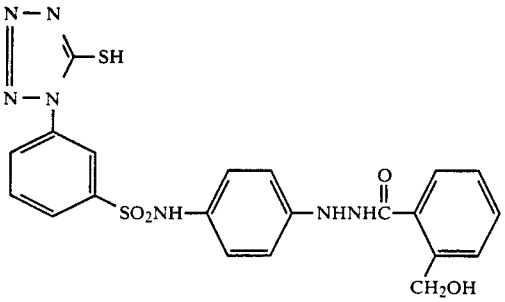

-continued
(I-21)
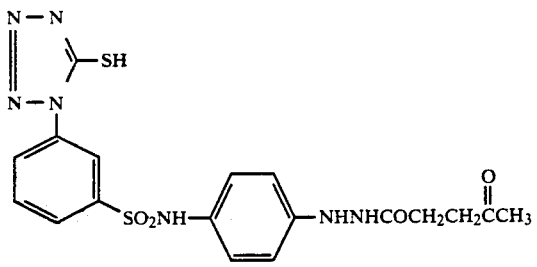
(I-22)
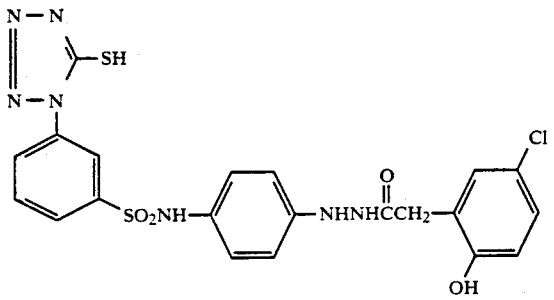
(I-23)
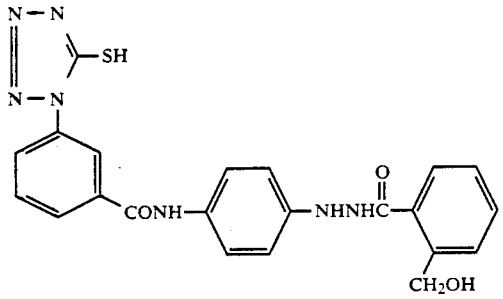
(I-24)
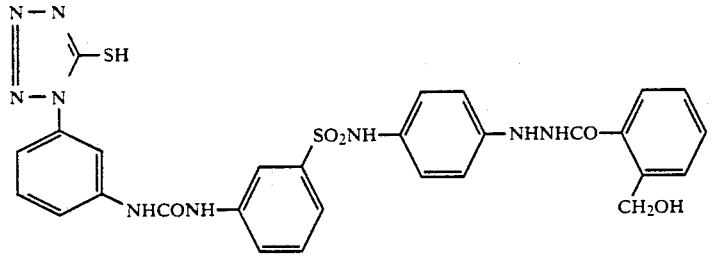
(I-25)
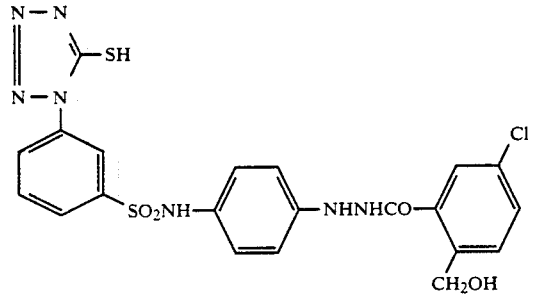

-continued (I-26)

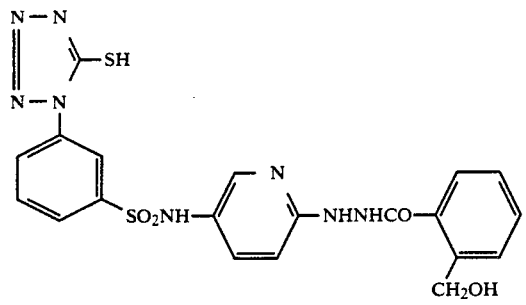

The compounds of the present invention can be synthesized using generally known methods. For example, they can be synthesized using the synthesis methods disclosed in JP-A-59-200230, JP-A-61-270744, JP-A-62-948, JP-A-63-29751, JP-A-63-234244, JP-A-63-234245 and JP-A-63234246. In this regard, synthesis methods for compounds of general formula (I) are explained by way of example below.

SYNTHESIS EXAMPLE 1

To prepare compound I-24 identified above, 38.3 g of p-nitrophenylhydrazine and 33 g of phthalide were heated in acetonitrile for 3 hours at 70°-80° C. After cooling to 20° C., the solid product was stirred together with ether and then the product was collected by filtration and washed with ether to obtain 7.2 g of 1-(2'-hydroxymethylbenzoyl)-2-(p-nitrophenyl)hydrazine.

Thereafter, the nitro compound was added to 300 ml of isopropyl alcohol with the addition of 30 ml of water and 3 g of ammonium chloride followed by reflux for 2 hours with the addition of 30 g of reducing iron and then the reflux liquid was filtered and the solid precipitated upon cooling the filtrate was filtered to obtain 4.2 g of 1-(2'-hydroxymethylbenzoyl)-2-(p-aminophenyl)-hydrazine.

5.2 g of the amino compound was then dissolved by adding, under a nitrogen atmosphere, 10 ml of N,N-dimethylacetamide, 6.5 ml of acetonitrile and 2.1 g of triethylamine. After cooling to −5° C., 4.5 g of m-nitrobenzenesulfonyl chloride was slowly added. During this time, stirring was carried out with cooling such that the liquid temperature did not exceed −5° C. After stirring at −5° C. or below for 1.5 hours, the liquid was taken to room temperature and extraction was carried out with 12 l of ethyl acetate and 12 l of a saturated salt solution. The organic layer was fractionated off and concentrated to 6 l, 3 l of n-hexane was then added and this was stirred at room temperature for 30 minutes. The crystals which had formed were filtered and washed with 500 ml of ethyl acetate to obtain 7.8 g of a 2-(4-(3-nitobenzenesulfonamido)phenyl) compound.

6.1 g of iron powder, 0.6 g of ammonium chloride, 60 ml of isopropanol and 2.2 l of water were mixed and heating and stirring were carried out over a steam bath. 7.8 g of the nitro compound mentioned above were added and refluxing was carried out for an additional 1.5 hours. Next, the undissolved substance was filtered and water was added after concentrating the filtrate under reduced pressure. The crystals which were formed were collected by filtration and washed with 1 l of isopropanol to obtain 6.8 g of a 2-(4-(3-aminobenzenesulfonamido)phenyl) compound.

6.8 g of this amino compound were dissolved in 32 ml of N,N-dimethylacetamide, cooled to −5° C. or below and, after adding 1.35 ml of pyridine, 2.6 g of phenyl chloroformate was added dropwise. During this time, stirring was carried out with cooling such that the temperature did not exceed −5° C. After stirring at −5° C. of less for 1 hour, the reaction liquid was added dropwise to 20 l of a saturated salt solution and stirring was carried out for 30 minutes. The crystals which were produced were collected by filtration and then washed with 2 l of water to obtain 8.4 g of a urethane compound.

Imidazole and 4.1 g of 1-(3-aminophenyl)-5-mercaptotetrazole hydrochloride were dissolved in 30 ml of acetonitrile in a nitrogen atmosphere and heating was carried out to 65° C. A solution in which 8.4 g of the above urethane compound had been dissolved in 40 ml of N,N-dimethylacetamide was added dropwise to this and stirring was carried out with heating at 65° C. for 1.5 hours. After cooling to 30° C., extraction was carried out with 160 ml of ethyl acetate and 160 ml of water and the aqueous layer was poured into a dilute aqueous hydrochloric acid solution. The crystals which were produced were collected by filtration and washed with water. There was a yield of 4.4 g with the product having a melting point 205° C. (decomposed).

SYNTHESIS EXAMPLE 2

To prepare compound I-2 identified above, 5.2 g of the 1-(2'-hydroxymethylbenzoyl)-2-(p-amino-phenyl) hydrazine obtained in Synthesis Example 1 was dissolved in 32 ml of N,N-dimethylacetamide in a nitrogen atmosphere. After cooling to −5° C. or below and adding 1.35 ml of pyridine, 2.6 g of phenyl chloroformate was added dropwise. During this time, stirring was carried out with cooling such that the temperature did not exceed −5° C. After stirring at −5° C. or below for 1 hour, the reaction liquid was added dropwise to 20 l of a saturated solution of salt, and stirring was carried out for 30 minutes. The crystals which were formed were collected by filtration and then washed with 20 l of water to obtain 6.5 g of a urethane compound.

Imidazole and 4.5 g of 1-(3-aminophenyl)-5-mercaptotetrazole hydrochloride were then dissolved in 30 ml of acetonitrile in a nitrogen atmosphere and heating was carried out to 65° C. A solution in which 6.5 g of the above urethane compound had been dissolved in 58 ml of N,N-dimethylacetamide was added dropwise, and stirring was carried out with heating at 65° C. for 1.5 hours. After cooling to 30° C., extraction was carried out with 170 ml of ethyl acetate and 170 ml of water and the aqueous layer was poured into a dilute aqueous hydrochloric acid solution. The crystals which were produced were collected by filtration and washed with water. There was a yield of 5.7 g, with the product having a melting point 215°-220° C. (decomposed).

The incorporation of the present compound in the photographic emulsion layer or hydrophilic colloid layer (particularly preferably in the photographic emulsion layer) can be accomplished by dissolving the present compound in water or an organic solvent miscible with water (optionally adding alkali hydroxide or a tertiary amine to the solution to make a salt which will be then dissolved in the solution), and then adding the solution to a hydrophilic colloid solution (e.g., aqueous solution of silver halide or gelatin) while the pH value thereof may be optionally adjusted with an acid or alkali.

The compounds of the present invention may be used, singly or in combination. The amount of the present compound to be incorporated is preferably in the range of from $1\times10^{-5}$ to $5\times10^{-2}$ mol and particularly preferably from $2\times10^{-5}$ to $1\times10^{-2}$ mol, per 1 mol of silver halide, and can be properly selected depending on the properties of the silver halide emulsion to be used in combination.

The compound represented by formula (I) can be used in combination with a negative type emulsion to form a negative image with a high contrast. The compound may be also used in combination with an internal latent image type silver halide emulsion. The compound may be preferably used in combination with a negative type emulsion to form a negative image with high contrast.

The average particle size of silver halide to be used in the formation of a negative image with a high contrast is preferably in the range of 0.7 μm or less (finely divided particle range) and particularly preferably 0.5 μm or less. The particle size distribution is not particularly limited but is preferably in the range of monodispersion. The term "monodispersion" as used herein means a particle composition such that at least 95% by weight or number of the total particles have a particle size within ±40% of the average particle size.

The silver halide grains to be incorporated in the photographic emulsion may have a regular crystal structure such as cubic, octahedron, rhombic dodecahedron, and tetradecahedron, an irregular crystal structure such as sphere and tabular, or a composite thereof.

The silver halide grains may have a structure such that the phase is uniform from the internal portion to the surface or different from the internal portion to the surface.

The silver halide emulsion to be used in the present invention may coexist cadmium salts, sulfites, lead salts, thallium salts, rhodium salts or complex salts thereof, or iridium salts or complex salts thereof in the process of formation or physical ripening, of silver halide grains.

The silver halide to be used in the present invention is prepared in the presence of an iridium salt or its complex salt in an amount of $1\times10^{-8}$ to $1\times10^{-5}$ mol per 1 mol of silver. The silver halide to be used in the present invention may be silver haloiodide having a greater silver iodide content in the surface thereof than the average silver iodide content. The use of an emulsion containing such a silver haloiodide provides a higher sensitivity and a higher gradation (i.e., a higher gamma value).

The silver halide emulsion to be used in the present invention may or may not be subjected to chemical sensitization. As methods for chemical sensitization of silver halide emulsions there have been known sulfur sensitization process, reduction sensitization process and noble metal sensitization process. These chemical sensitization processes may be used, singly or in combination.

A typical example of noble metal sensitization process is gold sensitization process using a gold compound, particularly a gold complex. The chemical sensitizing agent may comprise complexes of noble metals other than gold, such as platinum, palladium, or rhodium. Specific examples of such sensitizing agents are described in U.S. Pat. No. 2,448,060 and British Patent No. 618,016. As sulfur sensitizing agents there may be used sulfur compounds contained in gelatin, or various sulfur compounds such as thiosulfates, thioureas, thiazoles and rhodanines.

An iridium salt or rhodium salt may be preferably used before the completion of physical ripening, particularly during the formation of grains, in the process of preparation of silver halide emulsion.

In the present invention, the silver halide emulsion layer may preferably contain two monodisperse emulsions having different average particle sizes as disclosed in JP-A-61-223734 and JP-A-62-90646 in the light of increase in the maximum density ($D_{max}$). The monodisperse grains having smaller average grain size may be preferably subjected to chemical sensitization. The chemical sensitization may be most preferably affected by sulfur sensitization. A monodisperse emulsion having greater average particle size may be or may not be subjected to chemical sensitization. A monodisperse emulsion having greater average particle size is normally susceptible to black pepper and, therefore, not subjected to chemical sensitization. However, if a monodisperse emulsion having greater average particle size is subjected to chemical sensitization, the chemical sensitization may be most preferably affected so lightly that the emulsion does not develop black pepper. That is, such a chemical sensitization can be accomplished by using shorter chemical sensitization time, a lower chemical sensitization temperature or a lower added amount of chemical sensitizers than chemical sensitization for a monodisperse emulsion having smaller average particle size. The difference in sensitivity between a monodisperse emulsion having greater average particle size and a monodisperse emulsion having smaller average particle size is not particularly limited. However, the difference is preferably in the range of from 0.1 to 1.0 and particularly preferably from 0.2 to 0.7 as calculated in terms of ΔllogE. A monodisperse emulsion having greater average particle size preferably has a higher sensitivity than a monodisperse emulsion having smaller average particle size. The sensitivity of each emulsion can be determined when a light-sensitive material is obtained by incorporating a hydrazine derivative in the emulsion and then coating the emulsion on a support and processing with a developing solution having a pH of 10.5 to 12.3 containing 0.15 mol/l or more of sulfinic acid ion. The average particle size of the small size monodisperse grains is 90% or less and preferably 80% or less of that of the large size monodisperse grains. The average particle size of the silver halide emulsion grains is preferably in the range of from 0.02 to 1.0 μm and particularly preferably from 0.1 to 0.5 μm within which the average particle size of the large size and small size monodisperse grains preferably fall.

In the present invention, when two or more emulsions having different sizes are used, the coated amount of silver in the small size monodisperse emulsion is generally from 40 to 90% by weight and particularly preferably from 50 to 80% by weight based on the total coated amount of silver.

In the present invention, monodisperse emulsions having different particle sizes may be incorporated in the same emulsion layer or separately in separate emulsion layers. When the emulsions are incorporated in separate emulsion layers, the large size emulsion is preferably incorporated in the upper layer and the small size emulsion is preferably incorporated in the lower layer.

The total coated amount of silver is preferably in the range of from 1 to 8 $g/m^2$.

The light-sensitive material to be used in the present invention may comprise sensitizing dyes (e.g., cyanine dyes and merocyanine dyes) such as those described in JP-A-55-52050 (pp. 45–53) for the purpose of increasing sensitivity. These sensitizing dyes may be used, singly or in combination. Combinations of sensitizing dyes are often used particularly for the purpose of supersensitization. In combination with a sensitizing dye, a dye which has no spectral sensitizing effect itself or a substance which does not substantially absorb visible light but exhibits a supersensitizing effect may be incorporated in the emulsion. Useful sensitizing dyes, dye combinations exhibiting a supersensitizing effect and substances exhibiting a supersensitizing effect are described in *Research Disclosure*, No. 17643 (vol. 176, December, 1978, IV-J, page 23).

The photographic emulsion to be used in the present invention may comprise various compounds for the purpose of inhibiting fog during the preparation, preservation or photographic processing of the light-sensitive material or stabilizing the photographic properties thereof. Examples of such compounds include many compounds known as fog inhibitors (i.e., antifoggants) or stabilizers, such as azoles (e.g., benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles); mercaptopyrimidines; mercaptotriazines, thioketo compounds [e.g., oxazolinethione; azaindenes (e.g., triazaindenes, tetraazaindenes (particularly 4-hydroxy-substituted (1,3,3*a*, 7)tetrazaindenes), pentaazaindenes]; benzenethiosulfonic acid; benzenesulfinic acid; and benzenesulfonic amide. Preferred among these compounds are benzotriazoles such as 5-methyl-benzotriazole and nitroindazoles such as 5-nitroindazole. These compounds may be incorporated in the processing solution.

As suitable development accelerators or nucleation infectious development accelerators there may be used compounds such as those disclosed in JP-A-53-77616, JP-A-54-37732, JP-A-53-137133, JP-A-60-140340 and JP-A-60-14959 or various nitrogen- or sulfur-containing compounds.

The optimum amount of these accelerators is incorporated depends on the type of accelerator but is normally in the range of from $1.0\times10^{-3}$ to 0.5 $g/m^2$ and preferably from $5.0\times10^{-3}$ to 0.1 $g/m^2$.

In the present light-sensitive material, a desensitizer may be incorporated in the photographic emulsion layer or other hydrophilic colloidal layers.

The organic desensitizer to be used in the present invention is specified by the redox potential determined by its polarographic half wave potential, i.e., polarography such that the sum of the polarograph anodic potential and the polarograph cathodic potential is positive. The measurement of polarographic redox potential is described in e.g., U.S. Pat. No. 3,501,307. The organic desensitizer may preferably contain at least one water-soluble group such as a sulfonic group, carboxylic group or sulfone group. These water-soluble groups may form salts with organic bases (e.g., ammonia, pyridine, triethylamine, piperidine, and morpholine) or alkaline metals (e.g., sodium, potassium).

As suitable organic desensitizers there may be preferably used those represented by the formulae (III) to (V) as described in JP-A-63-133145 (pp. 55–72).

The present organic desensitizer may be preferably present in the silver halide emulsion layer in an amount of from $1.0\times10^{-8}$ to $1.0\times10^{-4}$ $mol/m^2$ and particularly preferably from $1.0\times10^{-7}$ to $1.0\times10^{-5}$ $mol/m^2$.

The present emulsion layer or other hydrophilic colloidal layers may comprise water-soluble dyes as a filter dye or for the purpose of inhibiting irradiation, or for other various purposes. As such a filter dye there may be used a dye for reducing photographic sensitivity, preferably an ultraviolet absorber having a maximum spectral absorption in the inherent sensitivity region of silver halide or a dye with a substantial light absorption in the region of from 380 to 600 nm for improving the safety against safelight when the light-sensitive material is treated as a bright room-type light-sensitive material.

These dyes may be preferably incorporated and fixed in the emulsion layer or in the upper part of the silver halide emulsion layer, i.e., the light-insensitive hydrophilic colloidal layer farther than the silver halide emulsion layer with respect to the support, together with a mordant depending on the purpose of application.

The amount of these dyes to be incorporated depends on the molar absorption coefficient of ultraviolet absorber and is normally in the range of from $1\times10^{-2}$ to 1 $g/m^2$, and preferably from 50 mg to 500 $mg/m^2$.

The above described ultraviolet absorber may be incorporated in the coating solution in the form of a solution in a proper solvent such as water, alcohol (e.g., methanol, ethanol, propanol), acetone, methyl cellosolve or mixtures thereof.

As such an ultraviolet absorber there may be used an aryl-substituted benzotriazole compound, 4-thiazolidone compound, benzophenone compound, cinnamic ester compound, butadiene compound, benzooxazole compound or ultraviolet absorbing polymer.

Specific examples of such ultraviolet absorber are described in U.S. Pat. Nos. 3,533,794, 3,314,794, 3,352,681, 3,705,805, 3,707,375, 4,045,229, 3,700,455 and 3,499,762, JP-A-46-2784 and West German Patent Publication No. 1,547,863.

Examples of filter dyes include oxonol dyes, hemioxonol dyes, styryl dyes, merocyanine dyes, citanine dyes and azo dyes. In order to reduce residual color after development, a water-soluble dye or a dye decolorizable by an alkali or sulfinic ion may be preferably used.

Specific examples of such dyes which can be used in the present invention include pyrazoloneoxonol dyes such as those described in U.S. Pat. No. 2,274,782, diarylazo dyes such as those described in U.S. Pat. No. 2,956,879, styryl dyes or butadiene dyes such as those described in U.S. Pat. Nos. 3,423,207 and 3,384,487, merocyanine dyes such as those described in U.S. Pat. No. 2,527,583, merocyanine dyes or oxonol dyes such as those described in U.S. Pat. Nos. 3,486,897, 3,652,284 and 3,718,472, enaminohemioxonol dyes such as those described in U.S. Pat. No. 3,976,661, and dyes such as those described in British Patents 584,609 and 1,177,429, JP-A-48-85130, JP-A-49-99620 and JP-A-49-114420 and U.S. Pat. Nos. 2,533,472, 3,148,187, 3,177,078, 3,247,127, 3,540,887, 3,575,704 and 3,653,905.

These dyes may be incorporated in the coating solution for the present light-insensitive hydrophilic colloidal layer in the form of a solution in a proper solvent such as water, alcohol (e.g., methanol, ethanol, propanol), acetone, methyl cellosolve or a mixture thereof.

The amount of these dyes to be used is normally in the range of from $1\times10^{-3}$ to 1 g/m$^2$ and particularly preferably from $1\times10^{-3}$ to 0.5 g/m$^2$.

The present photographic light-sensitive material may comprise an inorganic or organic film hardener in the photographic emulsion layer or other hydrophilic colloidal layers. As such a film hardener there may be used chromium salts, aldehydes such as formaldehyde and glutaraldehyde, N-methylol compounds such as dimethylolurea, active vinyl compounds such as 1,3,5-triacroyl-hexahydro-s-triazine and 1,3-vinylsulfonyl-2propanol, active halogen compounds such as 2,4-dichloro-6-hydroxy-s-triazine, and mucohalogenic acids, or combinations thereof.

The photographic emulsion layer or other hydrophilic colloidal layers in the light-sensitive material prepared according to the present invention may comprise various surface active agents for various purposes for example, as coating aids, as antistatic agents, for improvement of sliding properties, for improving emulsification and dispersion, for preventing adhesion, or for improving photographic properties such as acceleration of development, increase of contrast, and sensitization, or like purposes. As such surface active agents there may be particularly preferably used polyalkylene oxides having a molecular weight of 600 or more as described in JP-B-58-9412 (The term "JP-B" as used herein means "examined Japanese patent publication"). As a surface active agent to be used as an antistatic agent there may be particularly preferably used a fluorine-containing surface active agent such as those in U.S. Pat. No. 4,201,586 and JP-A-60-80849 and JP-A-59-74554.

The present photographic light-sensitive material may comprise a mat agent such as silica, magnesium oxide or polymethyl methacrylate in the photographic emulsion layer or other hydrophilic colloid layers for the purpose of preventing adhesion.

The present photographic emulsion may comprise a dispersion of a water-insoluble or sparingly water soluble synthetic polymer for the purpose of improving the dimensional stability. For example, a polymer comprising as monomer components alkyl (meth)acrylate alkoxyacryl (meth)acrylate, and glycidyl (meth)acrylate, singly or in combination, or a combination thereof with acrylic acid or methacrylic acid, may be used.

The silver halide emulsion layer and other layers in the present photographic light-sensitive material may preferably comprise a compound containing an acid group. Examples of such a compound containing an acid group include polymers or copolymers containing as repeating units organic acids such as salicylic acid, acetic acid or ascorbic acid, or acid monomers such as acrylic acid, maleic acid or phthalic acid. For these compounds, JP-A-61-223834, JP-A-61-228437, JP-A-62-25745 and JP-A-62-55642 can be referenced. Particularly preferred as low molecular compounds among these compounds are ascorbic acids. Particularly preferred as high molecular compounds among these compounds are water-dispersible latexes of copolymer comprising acid monomers such as acrylic acid and cross-linking monomers containing two or more unsaturated groups such as divinyl benzene.

When the present silver halide light-sensitive material is used to obtain ultrahigh contrast and high sensitivity, it is not necessary to use a conventional infectious developing solution or a highly alkaline developing solution with a pH value of nearly 13 as described in U.S. Pat. No. 2,419,975. Rather, a stable developing solution may be used.

In particular, the present silver halide light-sensitive material may be processed with a developing solution containing 0.15 mol/l or more of sulfinic ion as a preservative and having a pH value of from 10.5 to 12.3 and particularly preferably from 11.0 to 12.0, to provide negative images with sufficiently ultrahigh contrast.

The developing agent to be incorporated in the present developing solution is not particularly limited. In order to assist in, obtaining an excellent halftone quality, the present developing agent may preferably contain dihydroxybenzenes, or optionally a combination of dihydroxybenzenes and 1-phenyl-3-pyrazolidones, or a combination of dihydroxybenzenes and p-aminophenols. The present developing agent may be preferably used in an amount of from 0.05 to 0.8 mol/l. If a combination of dihydroxybenzenes and 1-phenyl-3-pyrazolidones or a combination of dihydroxybenzenes and p-aminophenols is used, the former may be preferably used in an amount of 0.05 to 0.5 mol/l or the latter may be preferably used in an amount of 0.06 mol/l or less.

Examples of sulfites to be used as preservatives in the present invention include sodium sulfite, potassium sulfite, lithium sulfite, ammonium sulfite, sodium bisulfite, potassium bisulfite, and formaldehyde sodium bisulfite. Such a sulfite may be preferably used in an amount of 0.4 mol/l or more and particularly preferably 0.5 mol/l or more.

The present developing solution may comprise as silver stain inhibitor a compound such as those described in JP-A-56-24347. As a dissolution aid to be incorporated in the developing solution there may be used a compound such as those described in JP-A-61-267759. As a pH buffer to be incorporated in the developing solution there may be used a compound such as those described in JP-A-60-93433 or JP-A-62-186259.

As described above, the compound represented by formula (I) may be incorporated in a high contrast light-sensitive material in combination with a negative type emulsion. Alternatively, the compound of formula (I) may be used in combination with an internal latent image-type silver halide emulsion. Embodiments of such an arrangement will be described hereafter. In this case, the compound of formula (I) may be preferably incorporated in an internal latent image-type silver halide emulsion layer. Alternatively, the compound of formula (I) may be incorporated in a hydrophilic colloidal layer adjacent to the internal latent image-type silver halide emulsion layer. Such a hydrophilic colloidal layer may be a layer having any function so long as it does not prevent a nucleating agent from diffusing into silver halide grains. Examples of such a hydrophilic colloidal layer include coloring material layer, interlayer, filter layer, protective layer and antihalation layer.

The amount of compound (I) to be incorporated in the layer is preferably such amount that when the internal latent image type emulsion is developed with a surface developing solution, sufficient maximum density (e.g., silver density of 1.0 or more) is provided. In particular, a suitable amount of the compound (I) to be incorporated in the layer depends on the properties of silver halide emulsion used, the chemical structure of nucleating agent and the developing conditions and therefore varies widely. However, a useful value of the amount of the compound (I) to be used in the layer is in the range of from about 0.005 to 500 mg and preferably from about 0.01 to about 100 mg, per 1 mol of silver in the internal latent image type silver halide emulsion. If compound (I) is incorporated in a hydrophilic colloidal layer adjacent to the emulsion layer, the same value as described above may be used based on the amount of silver contained in the same area of the internal latent image-type emulsion layer. The definition of such an internal latent image-type silver halide emulsion is described in JP-A-61-170733 (upper column on page 10) and British Patent 2,089,057 (pp. 18–20).

Examples of suitable internal latent image type emulsions which can be used in the present invention are described in JP-A-63-108336 (line 14 on page 28 to line 2 on page 31). Examples of suitable silver halide grains which can be used in the present invention are described in JP-A-63-108336 (line 3 on page 31 to line 11 on page 32).

In the present light-sensitive material, the internal latent image type emulsion may be spectrally sensitized with a sensitizing dye to blue light, green light, red light or infrared light in a relatively long wavelength. As such a sensitizing dye there may be used a cyanine dye, merocyanine dye, complex cyanine dye, complex merocyanine dye, holopolar cyanine dye, styryl dye, hemicyanine dye, oxonol dye or hemioxonol dye. Examples of these sensitizing dyes include cyanine dyes or merocyanine dyes such as those described in JP-A-59-40638, JP-A-59-40636 and JP-A-59-38739.

The present light-sensitive material may include a dye-forming coupler as a coloring material. Alternatively, the present light-sensitive material may be developed with a developing solution containing such a dye-forming coupler.

Specific examples of these cyan, magenta and yellow couplers which can be used in the present invention are described in the patents cited in *Research Disclosure*, Nos. 17643 (December, 1978, VII-D) and 18717 (November, 1979).

Couplers which develop a dye having a proper diffusivity, colorless couplers, DIR couplers which undergo coupling reaction to release a development inhibitor, or couplers which undergo coupling reaction to release a development accelerator may be used in the present invention.

Typical examples of yellow couplers which may be used in the present invention include oil protect type acylacetamide couplers.

In the present invention, two-equivalent yellow couplers may preferably used. Typical examples of such two-equivalent yellow couplers include oxygen atom-releasing type yellow couplers and nitrogen atom-releasing type yellow couplers. α-Pivaloylacetanilide couplers provide excellent fastness of color forming dye and particularly fastness to light. α-benzoylacetanilide couplers can provide a high color density.

As a suitable magenta coupler for the present invention there may be used an oil protect type indazolone or cyanoacetyl and preferably a 5-pyrazolone coupler or a pyrazoloazole coupler such as pyrazolotriazoles. As such a 5-pyrazolone coupler there may be preferably used a coupler which is substituted by an arylamino group or acylamino group in the 3-position in the light of hue of color forming dye or color density.

Particularly preferred examples of elimination groups for such a two-equivalent 5-pyrazolone coupler include nitrogen atom releasing groups such as those described in U.S. Pat. No. 4,310,619 and arylthio groups such as those described in U.S. Pat. No. 4,351,897. 5-Pyrazolone couplers containing ballast groups such as those described in European Patent 73,636, can provide high color density.

As suitable pyrazoloazole couplers there may be used pyrazolobenzimidazoles such as those described in U.S. Pat. No. 3,379,899 and preferably pyrazolo [5,1-c][1,2,4] triazoles such as those described in U.S. Pat. No. 3,725,067, pyrazolotetrazoles such as those described in *Research Disclosure*, No. 24220 (June, 1984) or pyrazolopyrazoles such as those described in *Research Disclosure*, No. 24230 (June, 1984). Imidazo[1,2-b]pyrazoles such as those described in European Patent 119,741 may be preferably used because of their small subsidiary absorption of yellow light by color forming dye and excellent fastness of color forming dye to light. Pyrazolo[1,5-b][1,2,4] triazoles such as those described in European Patent 119,860 may particularly preferably be used in the present invention.

As a suitable cyan coupler for the present invention there may be used an oil protect type naphthol or phenol coupler. Typical examples of such a coupler include naphthol couplers as described in U.S. Pat. No. 2,474,293. Preferred examples of such a coupler include oxygen atom-releasing type two-equivalent naphthol couplers as described in U.S. Pat. Nos. 4,052,212, 4,146,396, 4,228,233, and 4,296,200. Specific examples of such a phenol coupler are described in U.S. Pat. Nos. 2,369,929, 2,801,171, 2,772,162 and 2,895,826. Cyan couplers which are fast to heat and moisture may be preferably used in the present invention. Typical examples of such cyan couplers include phenol cyan couplers containing an ethyl group or higher group in the meta-position of phenol nucleus, 2,5-diacylamino-substituted phenol couplers and phenol couplers containing a phenylureido group in the 2-position and an acylamino group in the 5-position such as those described in U.S. Pat. No. 3,772,002.

In order to eliminate undesirable absorption of short wavelength range by a dye produced from a magenta or cyan coupler, a color negative light-sensitive material for use in cameras may preferably comprise a colored coupler.

The graininess of the light-sensitive material can be improved by using a coupler which contains color dye having a proper diffusibility. Specific examples of such a dye-diffusible coupler are provided in U.S. Pat. No. 4,366,237 and British Patent 2,125,570. Specific examples of yellow, magenta or cyan couplers having a proper diffusibility are described in European Patent 96,470 and West German Patent Application (OLS) No. 3,234,533.

Dye-forming couplers and the above described special couplers may form a dimer or higher polymer. Typical examples of polymerized dye-forming couplers are described in U.S. Pat. Nos. 3,451,820 and 4,080,211. Specific examples of polymerized magenta couplers are described in British Patent 2,102,173 and U.S. Pat. No. 4,367,282.

In order to satisfy the properties required for light-sensitive materials, the various couplers may be incorporated in combination in the same light-sensitive layer or singly in two or more different light-sensitive layers.

The standard amount of color coupler to be used is in the range of from 0.001 to 1 mol per 1 mol of light-sensitive silver halide. Preferably, yellow couplers are used in an amount of from 0.01 to 0.5 mol per 1 mol of light-sensitive silver halide, magenta couplers are used in an amount of 0.003 to 0.3 mol per 1 mol of light-sensitive silver halide, and cyan couplers are used in an amount of 0.002 to 0.3 mol per 1 mol of light-sensitive silver halide.

In the present invention, a developing agent such as hydroxybenzenes (e.g., hydroquinones), aminophenols or 3-pyrazolidones may be incorporated in the light-sensitive material.

The photographic emulsion to be used in the present invention may be also used in combination with a dye-providing compound (coloring material) for color diffusion transfer process which releases a diffusible dye in correspondence to the development of silver halide in order to provide transferred images on the image receiving layer after a proper development process. As such coloring materials there have been known many coloring materials. In particular, a coloring material which normally stays nondiffusive but undergoes redox reaction with an oxidation product of a developing agent (or electron transfer agent) to make cleavage, causing the release of a diffusible dye, may be preferably used (hereinafter to referred to as "DRR compound"). Particularly preferred among these DRR compounds are DRR compounds containing N-substituted sulfamoyl groups. DRR compounds containing o-hydroxyarylsulfamoyl groups such as those described in U.S. Pat. Nos. 4,055,428, 4,053,312 and 4,336,322 or DRR compounds containing redox mother nucleus such as those described in JP-A-53-149328 may be preferably used in combination with the present nucleating agents. The combined use of such a DRR compound gives a rather small temperature dependence particularly during processing.

Specific examples of DRR compounds further include magenta dye-forming materials such as 1-hydroxy-2-tetramethylenesulfamoyl-4-[3'-methyl-4'-(2''-hydroxy-4''-methyl-5''-hexadecyloxyphenylsulfamoyl)-phenylazo]-naphthalene.

The details of color couplers which can be preferably used in the present invention are provided in JP-A-53-149328 (line 18 on page 33—end of page 40).

The present light-sensitive material, which has been imagewise exposed to light, may be preferably color-developed with a surface developing solution, having a pH value of 11.5 or less containing an aromatic primary amine color developing agent after or while being fogged with light or a nucleating agent, and then bleached and fixed to provide direct positive color images. The pH value of the developing solution may be preferably in the range of 10.0 to 11.0.

The fogging process may be affected in either a so-called "light fogging process" by which the entire surface of the light-sensitive layer is given a second exposure or a so-called "chemical fogging process" by which the light-sensitive material is developed in the presence of a nucleating agent. The present light-sensitive material may be developed in the presence of a nucleating agent and fogging light. Alternatively, a light-sensitive material containing a nucleating agent may be fogwise exposed to light.

The details of the light fogging process are provided in JP-A-63-108336 (line 4 on page 47 —line 5 on page 49). The details of nucleating agents which can be used in the present invention are provided in JP-A-63-108336 (line 6 on page 49 —line 2 on page 67). In particular, the compounds represented by formulae [N-1] and [N-2] may be preferably used in the present invention. Specific examples of these compounds include those represented by the formulae [N-I-1] to [N-I-10 ] described on pages 56 to 58 in the above Japanese patent application and those represented by the formulas [N-II-1] to [N-II-12] are described on pages 63 to 66 of that patent application.

Details of nucleation accelerating agents which can be used in the present invention are also provided in the above Japanese patent application (see line 11 on page 68 —line 3 on page 71). Particularly preferred among these nucleation accelerators are those represented by the formulae (A-1) to (A-13) described on pages 69 to 70 of the above patent application.

Details of color developing solutions which can be used in the development of the present light-sensitive material are provided on page 71, line 4 to page 72, line 9 of the above Japanese patent application. Specific examples of aromatic primary amine color developing agents which can be preferably used in the present invention include p-phenylenediamine compounds. Typical examples of such p-phenylenediamine compounds include 3-methyl-4-amino-N-ethyl-N-(β-methanesulfonamidoethyl) aniline, 3-methyl-4-amino-N-ethyl-N-(β-hydroxyethyl)aniline, 3-methyl-4-amino-N-ethyl-N-methoxyethylaniline, and sulfates and hydrochlorides thereof.

When the present light-sensitive material is subjected to a color diffusion transfer processing to form direct positive color images thereon, there may be used a black-and-white developing agent such as phenidone derivative in addition to the above described color developing agent.

A photographic emulsion layer which has been color-developed is normally subjected to bleaching. The bleaching may be affected simultaneously with fixation (combined bleaching and fixing) or separately from fixation In order to further expedite the processing, bleaching may be followed by blixing, or fixation may be followed by blixing. The present bleaching solution or blixing solution may formally comprise an iron aminopolycarboxylate complex as the bleaching agent. As additives to be incorporated in the present bleaching solution or blixing solution there may be used various compounds such as those described in JP-A-62-215272 (pp. 22–30). The desilvering process (blixing or fixation) may be followed by rinse and/or stabilization. The rinsing solution or stabilizing solution may preferably comprise softened water. In the process for softening water, an ion exchange resin or reverse osmosis apparatus as described in JP-A-62-288838 may be used. Specific examples of such a water softening process which can be used in the present invention, are described in JP-A-62-288838.

As additives to be incorporated in the rinsing solution or stabilizing solution there may be used various compounds such as those described in JP-A-62-215272 (pp. 30–36).

The less replenisher of each processing solution is, the better is the resulting property. The replenished amount of each processing solution is preferably in the range of from 0.1 to 50 times and particularly preferably from 3 to 30 times the amount of the solution carried over by the light-sensitive material from the prebath per unit area.

In the interest of brevity and conciseness, the contents of the aforementioned numerous patents and articles are hereby incorporated by reference.

The present invention will be further described in the following Examples, but the present invention should not be construed as being limited thereto.

EXAMPLE 1

An aqueous solution of silver nitrate and an aqueous solution of potassium iodide and potassium bromide were simultaneously added to an aqueous solution of gelatin which had been kept at a temperature of 50° C. in the presence of iridium (III) potassium hexachloride in an amount of $4\times10^{-7}$ mol per 1 mol of silver and ammonia in 60 minutes while the pAg value thereof was kept at 7.8. As a result, a monodisperse emulsion of cubic grains having an average particle diameter of 0.25 μm and an average silver iodide content of 1 mol % was obtained. The emulsion was not subjected to chemical sensitization. A sodium salt of 5,5'-dichloro-9-ethyl-3,3'-bis(3-sulfopropyl)oxacarbocyanine as a sensitizing dye, 4-hydroxy-6-methyl-1,3,3*a*,7-tetrazaindene as a stabilizer, a dispersion of polyethyl acrylate, polyethylene glycol, 1,3-vinylsulfonyl-2-propanol, and the compounds shown in Table 1 were added to these silver bromoiodide emulsions. The emulsions were each coated on a polyethylene terephthalate base in an amount of 3.4 g/m$^2$ as calculated in terms of amount of silver. The coated amount of gelatin was 1.8 g/m$^2$.

A layer comprising 1.5 g/m$^2$ of gelatin, 0.3 g/m$^2$ of polymethyl methacrylate grains (average particle diameter: 2.5 μm) and the following surface active agents, was coated on the emulsion coat as a protective layer.

| Surface active agent | |
|---|---|
| 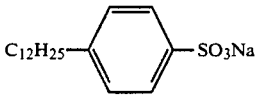 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2N(C_3H_7)CH_2COOK$ | 2.5 mg/m$^2$ |

Comparative samples were prepared in the same manner as the aforementioned samples except that the compounds useful in the present invention were replaced by Compounds A, B, C, D and E which are described in JP-A-63-29751. These compounds are shown in Table 1.

The samples were then exposed to light by a 3,200 °K tungsten lamp through an optical wedge and an ND filter having an optical density of 1.5, developed with the following developing solution at a temperature of 34° C. over 30 seconds, fixed, washed with water and dried.

The resulting photographic properties are shown in Table 1.

It can be seen that when the compounds of the invention were used, notably high sensitivities and high-contrast properties were obtained when used in small amounts.

| Developing solution I | |
|---|---|
| Hydroquinone | 50.0 g |
| N-methyl-p-aminophenol | 0.3 g |
| Sodium hydroxide | 18.0 g |
| Boric acid | 54.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-butyldiethanolamine | 15.0 g |
| Sodium toluenesulfonate | 8.0 g |
| Water to make | 1 l |
| pH adjusted with potassium hydroxide to | 11.6 |

TABLE 1

| Sample No. | Compound (Nucleating agent) | Added amount (mol/mol-silver) | Photographic Properties Sensitivity*1 | γ*2 |
|---|---|---|---|---|
| 1 (Comparative Example-1) | — | 0 | Standard | 2.1 |
| 2 (Comparative Example -2) | Comparative Compound A | $2.1\times10^{-3}$ | +0.46 | 4.7 |
| 3 (Comparative Example-3) | Comparative Example-3) | " Compound B | +0.49 | |
| 4 (Comparative Example-4) | Comparative Compound C | " | +0.41 | 3.5 |
| 5 (Comparative Example-5) | Comparative Compound D | $3.2\times10^{-4}$ | +0.52 | 10.0 |
| 6 (Comparative Example-6) | Comparative Compound E | " | +0.55 | 12.1 |
| 7 (Present Example-1) | Exemplary Compound I-1 | " | +0.65 | 15.5 |
| 8 (Present Example-2) | Exemplary Compound I-2 | " | +0.78 | 16.5 |
| 9 (Present Example-3) | Exemplary Compound I-3 | " | +0.97 | 20.7 |
| 10 (Present Example-4) | Exemplary Compound I-5 | " | +0.80 | 17.0 |
| 11 (Present Example-5) | Exemplary Compound I-7 | " | +0.73 | 17.1 |
| 12 (Present Example-6) | Exemplary Compound I-10 | " | +0.88 | 19.0 |
| 13 (Present Example-7) | Exemplary Compound I-20 | " | +1.00 | 29.4 |
| 14 (Present | Exemplary | " | +0.70 | 16.5 |

TABLE 1-continued

| Sample No. | Compound (Nucleating agent) | Added amount (mol/mol-silver) | Photographic Properties Sensitivity*1 | γ*2 |
|---|---|---|---|---|
| Example-8) | Compound I-23 | | | |

*1The sensitivity is represented in terms of the difference from log E of the sensitivity of Comparative Example-1 as standard. Therefore, a sensitivity of +1.0 means a sensitivity 1.0 higher as calculated in terms of log E, e.g., 10 times higher than the blank.

*2gradation (γ): Gradation (γ) is represented in terms of gradient of the straight line from the point of density of 0.3 to the point of density of 3.0 on the characteristic curve. The greater this value is, the harder the contrast.

Comparative Compound A

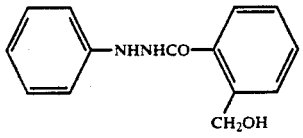

Comparative Compound B

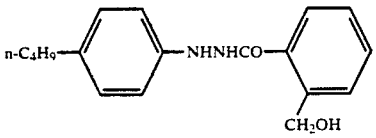

Comparative Compound C

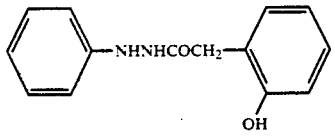

Comparative Compound D

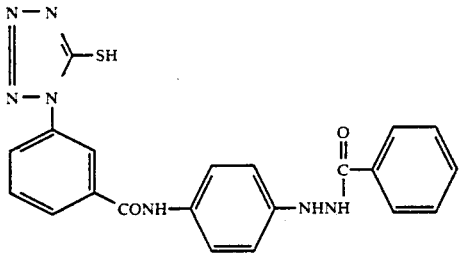

Comparative Compound E

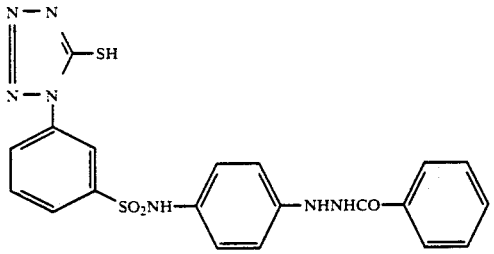

EXAMPLE 2

The samples prepared in Example 1 were developed with the following developing solution at a temperature of 38° C. over 30 seconds, fixed, washed with water, and dried.

| Developing solution II | |
|---|---|
| Hydroquinone | 25 g |
| 4-Methyl-4-hydroxymethyl-1-phenyl-3-pyrazolidone | 0.5 g |
| Disodium ethylenediaminetetraacetate | 10.8 g |
| Potassium hydroxide | 10.5 g |
| Sodium carbonate (monohydrate) | 11.5 g |
| Sodium sulfite (anhydride) | 66.7 g |
| Potassium bromide | 3.3 g |
| 5-Methylbenzotriazole | 0.4 g |

-continued

| Developing solution II | |
|---|---|
| Sodium 3-(5-mercaptotetrazole)benzene-sulfonate | 0.2 g |
| Sodium 2-mercaptobenzimidazole-5-sulfonate | 0.3 g |
| β-Phenetyl alcohol | 2.0 ml |
| Water to make | 1 l |
| pH adjusted with potassium hydroxide to | 10.7 |

The resulting photographic properties were shown in Table 2. With the present compounds, high sensitivity and contrast could be obtained from a developing solution having a low pH value of 10.7.

TABLE 2

| | Sample No. | Photographic property Sensitivity | γ |
|---|---|---|---|
| 1 | (Comparative Example-1) | Standard | 1.8 |
| 2 | (Comparative Example-2) | +0.27 | 3.0 |
| 3 | (Comparative Example-3) | +0.31 | 3.5 |
| 4 | (Comparative Example-4) | +0.25 | 2.4 |
| 5 | (Comparative Example-5) | +0.34 | 5.3 |
| 6 | (Comparative Example-6) | +0.37 | 9.5 |
| 7 | (Present Example-1) | +0.54 | 13.2 |
| 8 | (Present Example-2) | +0.57 | 14.8 |
| 9 | (Present Example-3) | +0.81 | 19.3 |
| 10 | (Present Example-4) | +0.54 | 13.4 |
| 11 | (Present Example-5) | +0.55 | 14.1 |
| 12 | (Present Example-6) | +0.78 | 18.5 |
| 13 | (Present Example-7) | +0.87 | 20.6 |
| 14 | (Present Example-8) | +0.56 | 14.5 |

EXAMPLE 3

An aqueous solution of silver nitrate and an aqueous solution of sodium chloride were simultaneously added to an aqueous solution of gelatin which had been maintained at a temperature of 40° C. in the presence of $(NH_4)_3RhCl_6$ in an amount of $5.0\times10^{-6}$ mol per 1 mol of silver. Soluble salts were removed from the emulsion by a flocculation method commonly known in the art. Gelatin was then added to the emulsion. The emulsion was not subjected to chemical sensitization. 2-Methyl-4-hydroxyl,1,3,3*a*,7-tetraazaindene was added to the emulsion as a stabilizer. As a result, a monodisperse emulsion of cubic grains having an average particle size of 0.18 μm was obtained.

Hydrazine compounds shown in Table 3 and polyethyl acrylate latexes were added to the emulsions in an amount of 30% by weight as calculated in terms of solid content. 1,3-Vinylsulfonyl-2-propanol was added to the emulsions as a film hardener. These emulsions were then each coated on a polyester support in an amount of 3.8 g/m² as calculated in terms of amount of silver. The coated amount of gelatin was 1.8 g/m². A layer comprising 1.5 g/m² of gelatin was coated on these emulsion coats as a protective layer.

The sample were then exposed to light through an optical wedge by a bright room printer ("P-607" manufactured by Dainippon Screen Co., Ltd.), developed with Developing Solution I used in Example 1 at a temperature of 38° C. over 30 minutes, fixed, washed with water, and dried.

The resulting photographic properties are shown in Table 3. Table 3 shows that the present compounds provide higher contrast and sensitivity when used in small amounts.

TABLE 3

| Sample No. | Compound (Nucleating Agent) | Added amount (mol/mol-silver) | Photographic property Sensitivity | Photographic property γ |
|---|---|---|---|---|
| 1 (Comparative Example-1) | — | 0 | standard | 7.0 |
| 2 (Comparative Example-2) | Comparative Compound A | $5.2 \times 10^{-3}$ | +0.23 | 8.1 |
| 3 (Comparative Example-3) | Comparative Compound B | " | +0.24 | 8.3 |
| 4 (Comparative Example-4) | Comparative Compound C | " | +0.21 | 7.8 |
| 5 (Comparative Example-5) | Comparative Compound D | $7.5 \times 10^{-4}$ | +0.30 | 8.1 |
| 6 (Comparative Example-6) | Comparative Compound E | " | +0.35 | 10.3 |
| 7 (Comparative Example-7) | Comparative Compound F | " | +0.28 | 7.5 |
| 8 (Present Example-1) | Exemplary Compound I-1 | " | +0.53 | 14.2 |
| 9 (Present Example-2) | Exemplary Compound I-2 | " | +0.77 | 16.7 |
| 10 (Present Example-3) | Exemplary Compound I-3 | " | +0.81 | 20.3 |
| 11 (Present Example-4) | Exemplary Compound I-5 | " | +0.55 | 15.0 |
| 12 (Present Example-5) | Exemplary Compound I-7 | " | +0.57 | 15.3 |
| 13 (Present Example-6) | Exemplary Compound I-10 | " | +0.78 | 19.2 |
| 14 (Present Example-7) | Exemplary Compound I-20 | " | +0.89 | 21.5 |
| 15 (Present Example-8) | Exemplary Compound I-23 | " | +0.60 | 15.3 |

*Comparative Compounds A, B, C, D and E were the same as used in Example 1.

Comparative Compound F

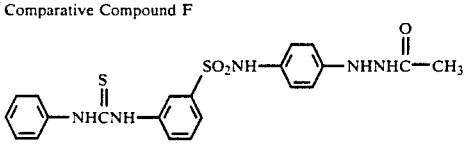

EXAMPLE 4

Preparation of Emulsion

An aqueous solution of silver nitrate and an aqueous solution of sodium chloride containing ammonium hexachlorinated rhodiumate (III) and an amount of $0.5 \times 10^{-4}$ mol per 1 mol of silver were mixed in a gelatin solution of 35° C. by a double jet process while the pH value thereof was adjusted to 6.5. As a result, a monodisperse emulsion of silver chloride grains having an average particle size of 0.07 μm was obtained.

Soluble salts were then removed from the emulsion by a flocculation method commonly known in the art. 4-Hydroxyl-6-methyl-1,3,3*a*, 7-tetraazaindene and 1-phenyl-5-mercaptotetrazole were added to the emulsion as stabilizers. The amount of gelatin and silver contained in 1 kg of the emulsion were 55 g and 105 g, respectively.

Preparation of light-sensitive material

The present and comparative nucleating agents shown in Table 4 and the following nucleation accelerator and safelight dye were added to the emulsion thus obtained.

| | Added amount |
|---|---|
| Nucleation accelerator | |
| 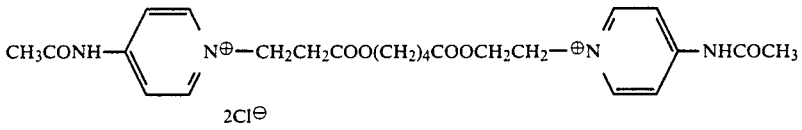 | 28.0 mg/m² |
| Safelight dye | |
| 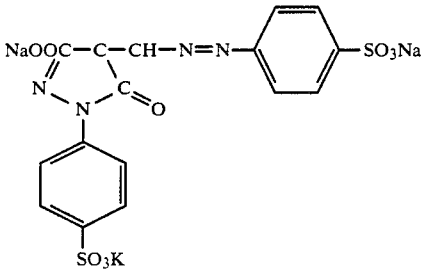 | 50.0 mg/m² |

A polyethyl acrylate latex (14 mg/m²) and 2,4-dichloro-6-hydroxy-1-1,3,5-triazine sodium salt as a film hardener were added to the emulsion. The silver halide emulsion was then coated on a transparent polyethylene terephthalate support in an amount of 3.5 g per 1 m² as calculated in terms of amount of silver. A protective layer comprising gelatin (1.3 g/m²), and the following three surface active agents, stabilizer and matting agent were coated on the emulsion coat and dried.

| | Added amount mg/m² |
|---|---|
| Surface active agent | |
| 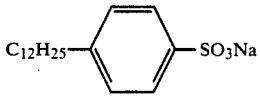 | 37 mg/m² |
| $CH_2COOC_6H_{13}$ / $CHCOOC_6H_{13}$ / $SO_3Na$ | 37 mg/m² |
| $C_8F_{17}SO_2N(C_3H_7)CH_2COOK$ | 2.5 mg/m² |
| Stabilizer Thioctic acid | 6.0 |

-continued

| | Added amount mg/m² |
|---|---|
| Matting agent<br>Polymethyl methacrylate (average particle diameter: 2.5 μm) | 9.0 |

These samples were then exposed to light through an optical wedge by a bright room printer ("P-607" manufactured by Dainippon Screen Co., Ltd.), developed with Developing solution I at a temperature of 38° C. over 20 seconds, fixed, washed with water, and dried.

The resulting photographic properties are shown in Table 4.

The comparative examples provided low contrast image with a low gamma (γ) (i.e., gamma value of 2 to 4) while the present compound provided high contrast images with a gamma (γ) of 10 or more. The comparative samples exhibited no increase in the sensitivity while the present samples exhibited a remarkable increase in the sensitivity.

TABLE 4

| Sample No. | Compound (Nucleating Agent) | Added amount (mol/mol-silver) | Photographic property Sensitivity | γ |
|---|---|---|---|---|
| 1 (Comparative Example-1) | — | 0 | standard | 2.1 |
| 2 (Comparative Example-2) | Comparative Compound A | $6.4 \times 10^{-2}$ | ±0 | 2.3 |
| 3 (Comparative Example-3) | Comparative Compound B | " | ±0 | 2.1 |
| 4 (Comparative Example-4) | Comparative Compound C | " | ±0 | 2.1 |
| 5 (Comparative Example-5) | Comparative Compound D | $1.1 \times 10^{-3}$ | −0.12 | 2.1 |
| 6 (Comparative Example-6) | Comparative Compound E | " | −0.07 | 3.5 |
| 7 (Present Example-1) | Exemplary Compound I-2 | " | +0.34 | 11.7 |
| 8 (Present Example-2) | Exemplary Compound I-3 | " | +0.60 | 14.8 |
| 9 (Present Example-3) | Exemplary Compound I-10 | " | +0.59 | 14.5 |
| 10 (Present Example-4) | Exemplary Compound I-20 | " | +0.73 | 20.2 |
| 11 (Present Example-5) | Exemplary Compound I-22 | " | +0.71 | 18.6 |
| 12 (Present Example-6) | Exemplary Compound I-5 | " | +0.49 | 12.9 |

EXAMPLE 5

A multilayer color light-sensitive material sample A was prepared by coating various layers of the undermentioned compositions on a polyethylene support laminated on both surfaces of paper support.

| | |
|---|---|
| Layer E9 | Protective layer |
| Layer E8 | Ultraviolet absorbing layer |
| Layer E7 | Blue-sensitive emulsion layer |
| Layer E6 | Interlayer |
| Layer E5 | Yellow filter layer |
| Layer E4 | Interlayer |
| Layer E3 | Green-sensitive emulsion layer |
| Layer E2 | Interlayer |
| Layer E1 | Red sensitive emulsion layer |
| Support | Polyethylene support |
| Layer B1 | Back layer |
| Layer B2 | Protective layer |

Layer constitution

The composition of the various layers will be described hereafter. The values of coated amount are represented in gram per m². The coated amount of silver halide emulsion and colloidal silver is represented in gram per m² as calculated in terms of amount of silver. The coated amount of spectral sensitizing dye is represented in terms of mole per 1 mol of silver halide incorporated in the same layer.

Support

The support is a Polyethylene-laminated paper containing a white pigment ($TiO_2$) and a bluish dye (ultramarine) in polyethylene on layer E1 side.

| | |
|---|---|
| Layer E1 | |
| Silver halide emulsion A | 0.26 |
| Spectral sensitizing dye ExSS-1 | $1.0 \times 10^{-4}$ |
| Spectral sensitizing dye ExSS 2 | $6.1 \times 10^{-5}$ |
| Gelatin | 1.11 |
| Cyan coupler ExCC-1 | 0.21 |
| Cyan coupler ExCC-2 | 0.26 |
| Ultraviolet absorber ExUV-1 | 0.17 |
| Solvent ExS-1 | 0.23 |
| Development adjustor ExGC-1 | 0.02 |
| Stabilizer ExA-1 | 0.006 |
| Nucleation accelerator ExZS-1 | $3.0 \times 10^{-4}$ |
| Nucleating agent ExZK-1 | $8.0 \times 10^{-5}$ |
| Layer E2 | |
| Gelatin | 1.41 |
| Color stain inhibitor ExKB-1 | 0.09 |
| Solvent ExS-1 | 0.10 |
| Solvent ExS-2 | 0.10 |
| Layer E3 | |
| Silver halide emulsion A | 0.23 |
| Spectral sensitizing dye ExSS-3 | $3.0 \times 10^{-4}$ |
| Gelatin | 1.05 |
| Magenta coupler ExMC-1 | 0.16 |
| Dye stabilizer ExSA-1 | 0.20 |
| Solvent ExS-3 | 0.25 |
| Development adjustor ExGC-1 | 0.02 |
| Stabilizer ExA-1 | 0.006 |
| Nucleation accelerator ExZS-1 | $2.7 \times 10^{-4}$ |
| Nucleating agent ExZK-1 | $1.4 \times 10^{-4}$ |
| Layer E4 | |
| Gelatin | 0.47 |
| Color stain inhibitor ExKB-1 | 0.03 |
| Solvent ExS-1 | 0.03 |
| Solvent ExS-2 | 0.03 |
| Layer E5 | |
| Colloidal silver | 0.09 |
| Gelatin | 0.49 |
| Color stain inhibitor ExKB-1 | 0.03 |
| Solvent ExS-1 | 0.03 |
| Solvent ExS-2 | 0.03 |
| Layer E6 | |
| Same as Layer E4 | |
| Layer E7 | |
| Silver halide emulsion A | 0.40 |
| Spectral sensitizing dye ExSS-4 | $4.2 \times 10^{-4}$ |
| Gelatin | 2.17 |
| Yellow coupler ExYC-1 | 0.51 |
| Solvent ExS-2 | 0.20 |
| Solvent ExS-4 | 0.20 |
| Development adjustor ExGC-1 | 0.06 |
| Stabilizer ExA-1 | 0.006 |
| Nucleation accelerator ExZS-1 | $5.0 \times 10^{-4}$ |
| Nucleating agent ExZK-1 | $1.2 \times 10^{-5}$ |
| Layer E8 | |
| Gelatin | 0.54 |
| Ultraviolet absorber ExUV-2 | 0.21 |
| Solvent ExS-4 | 0.08 |
| Layer E9 | |
| Gelatin | 1.28 |
| Acryl-modified copolymer of polyvinyl alcohol (modification degree: 17%) | 0.17 |

-continued

| | |
|---|---|
| Liquid paraffin | 0.03 |
| Polymethacrylic acid methyl latex grains (average particle diameter: 2.8 μm) | 0.05 |
| Layer B1 | |
| Gelatin | 8.70 |
| Layer B2 | |
| Same as Layer E9 | |

Besides the above described compositions, a gelatin hardener ExGK-1 and a surface active agent were incorporated in each layer.

Silver halide emulsion A

An aqueous solution of potassium bromide and sodium chloride and an aqueous solution of silver nitrate were added at the same time to an aqueous solution of gelatin comprising 3,4-dimethyl-1,1,3-thiazoline-2-thione and lead acetate in amounts of 0.5 g and 0.3 g based on 1 mol of silver, respectively, with vigorous stirring at a temperature of 55° C. for about 5 minutes to obtain a monodisperse emulsion of silver bromochloride grains having an average particle diameter of about 0.2 μm (silver bromide content: 40 mol %). Sodium thiosulfate and chloroauric acid (tetrahydrate) were added to the emulsion in amounts of 35 mg and 20 mg based on 1 mol of silver, respectively The emulsion was then heated to a temperature of 55° C. over 60 minutes and subjected to chemical sensitization.

The emulsion was further processed under the same percipitation conditions as described above with the silver bromochloride as cores over 40 minutes to provide grains growth. Eventually, a monodisperse emulsion of core/shell silver bromochloride grains having an average particle diameter of 0.4 μm was obtained. The coefficient of variation in particle size of the grains was about 10%.

Sodium thiosulfate and chloroauric acid (tetrahydrate) were added to the emulsion in amounts of 3 mg and 3.5 mg based on 1 mol of silver, respectively. The emulsion was then heated to a temperature of 60° C. over 50 minutes and subjected to chemical sensitization. As a result, an internal latent image type silver halide emulsion A was obtained.

Compounds used in the preparation of sample

Cyan coupler ExCC-1

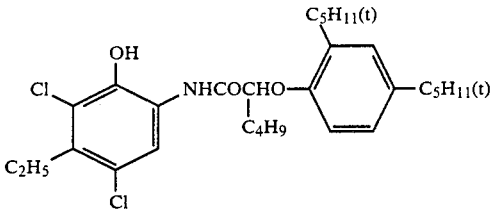

Cyan coupler ExCC-2

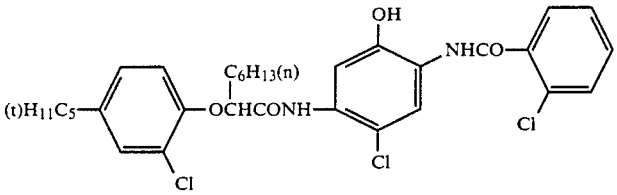

Magenta coupler ExMC-1

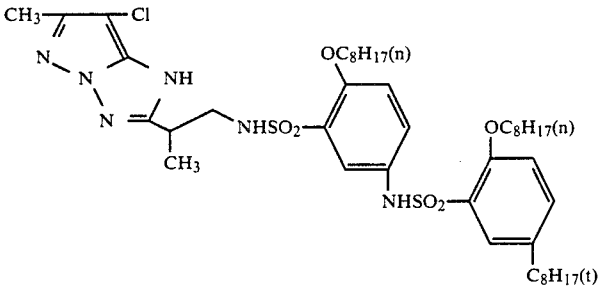

Yellow coupler ExYC-1

-continued
Compounds used in the preparation of sample
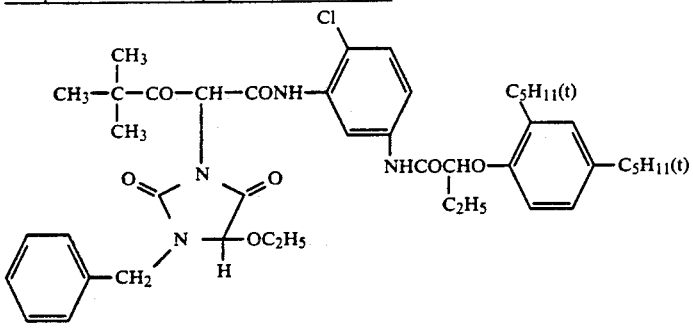
Spectral sensitizing dye ExSS-1
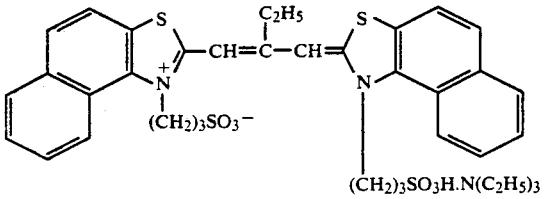
Spectral sensitizing dye ExSS-2
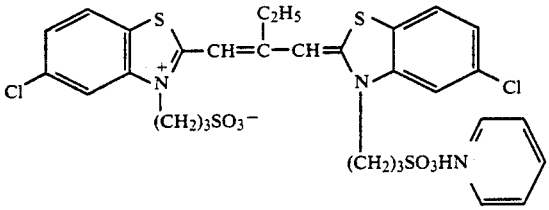
Spectral sensitizing dye ExSS-3
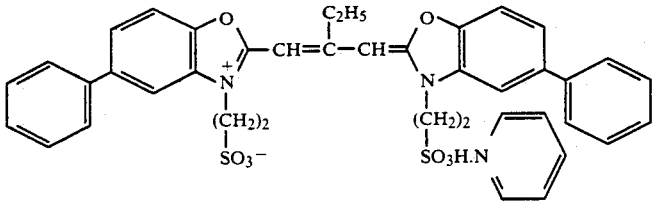
Solvent ExS-1
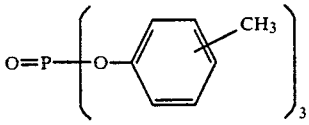
Solvent ExS-2
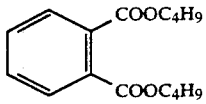
Solvent ExS-3
1/1 (volume ratio) mixing of $O{=}P{-}\left(OCH_2CH(C_2H_5)C_4H_9\right)_3$, $O{=}P{-}\left(O{-}C_6H_4{-}CH_3\right)_3$
Solvent ExS-4
$O{=}P{-}(O{-}C_9H_{19}(iso))_3$
Ultraviolet absorber ExUV-1

-continued

Compounds used in the preparation of sample

5/8/9 (weight ratio) of (1), (2) and (3):

(1)

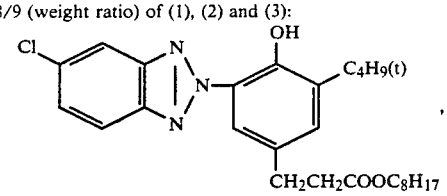

(2)

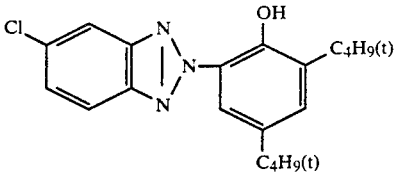

(3)

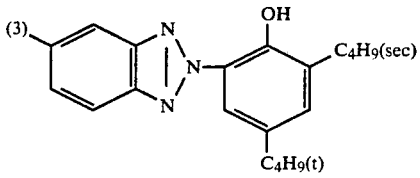

Ultraviolet absorber ExUV-2

2/9/8 (weight ratio) mixture of (1), (2) and (3) as described above

Dye stabilizer ExSA-1

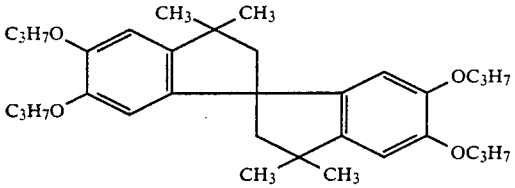

Color stain inhibitor ExKB-1

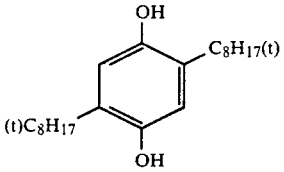

Development adjustor ExGC-1

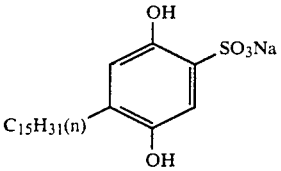

Stabilizer ExA-1

4-hydroxy-5,6-trimethylene-1,3,3a,7-tetrazaindene

Nucleation accelerator ExZS-1

2-(3-Dimethylaminopropylthio)-5-mercapto-1,3,4-thiadiazole hydrochloride

Nucleating Agent ExZK-1

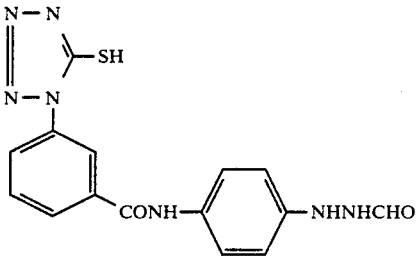

| Processing step A | | |
|---|---|---|
| Step | Time | Temperature |
| Color development | 100 sec. | 38° C. |
| Blixing | 30 sec. | 38° C. |

-continued

| Processing step A | | |
|---|---|---|
| Step | Time | Temperature |
| Rinse 1 | 30 sec. | 38° C. |

-continued

| Processing step A | | |
|---|---|---|
| Step | Time | Temperature |
| Rinse 2 | 30 sec. | 38° C. |

The replenisher of the rinsing solution was conducted in a countercurrent process in which the rinsing solution was replenished to the rinsing bath 2, and the overflow solution from the rinsing bath 2 was then passed to the rinsing bath 1.

| | Mother liquor (Tank solution) |
|---|---|
| Color developing solution | |
| Diethylenetriaminepentaacetic acid | 0.5 g |
| 1-Hydroxyethylidene-1,1-phosphonic acid | 0.5 g |
| Diethylene glycol | 8.0 g |
| Benzyl alcohol | 10.0 g |
| Sodium bromide | 0.5 g |
| Sodium chloride | 0.7 g |
| Sodium sulfite | 2.0 g |
| N,N-diethylhydroxylamine | 3.5 g |
| 3-Methyl-4-amino-N-ethyl-N-(β-methanesulfonamidoethyl)-aniline | 6.0 g |
| Potassium carbonate | 30.0 g |
| Fluorescent brightening agent (stilbene series) | 1.0 g |
| Pure water to make | 1,000 ml |
| pH adjusted with potassium hydroxide or hydrochloric acid | 10.50 |
| Blixing solution | |
| Ammonium thiosulfate | 110 g |
| Sodium hydrogensulfite | 10 g |
| Ferric ammonium ethylenediaminetetraacetate (dihydrate) | 40 g |
| Disodium ethylenediaminetetraacetate (dihydrate) | 5 g |
| 2-Mercapto-1,3,4-triazole | 0.5 g |
| Pure water to make | 1,000 ml |
| pH adjusted with aqueous ammonia or hydrochloric acid | 7.0 |
| Rinsing solution | |
| Pure water was used. | |

The pure water was obtained by subjecting tap water to an ion exchanger so that the concentration of all cations other than hydrogen ion and all an ions other than hydroxyl ion was reduced to 1 ppm or less.

Multilayer color light-sensitive material sample Nos. 1 to 8 were prepared in the same manner as in sample No. A except that the nucleating agent (ExZK-1) was replaced by the compounds shown in Table 5.

The samples thus prepared were then wedgewise exposed to light (1/10 second, 10 CMS), subjected to processing step A, and measured for cyan color image density.

The results are shown in Table 5.

TABLE 5

| Sample No. | Nucleating Agent | Cyan image density $D_{max}$ | $D_{min}$ |
|---|---|---|---|
| 1 | Exemplary compound I-1 | 1.9 | 0.11 |
| 2 | Exemplary compound I-2 | 2.0 | 0.11 |
| 3 | Exemplary compound I-3 | 2.3 | 0.11 |
| 4 | Exemplary compound I-7 | 1.9 | 0.11 |
| 5 | Exemplary compound I-15 | 2.2 | 0.11 |
| 6 | Exemplary compound I-22 | 2.1 | 0.11 |
| 7 | Exemplary compound I-23 | 2.3 | 0.11 |
| 8 | Comparative compound A | 1.0 | 0.15 |
| A | ExZK-1 | 1.4 | 0.12 |

The added amount of nucleating agent was equivalent to that of ExZK-1. ExZK-1 is shown above.

Sample Nos. 1 to 7 comprising the present nucleating agents exhibited higher maximum image densities ($D_{max}$) than Comparative sample Nos. 8 and A. As to magenta density and yellow density, similar results were obtained.

EXAMPLE 6

Light-sensitive element sample Nos. 1 to 8 were prepared by coating the following layers on a transparent polyethylene terephthalate support in the order described below.

(1) Mordant layer containing 3.0 g/m² of a copolymer containing the following repeating units in the following proportion as described in U.S. Pat. No. 3,898,088 and 3.0 g/m² of gelatin:

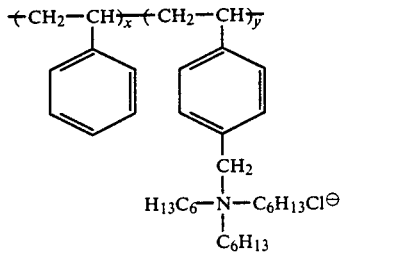

x/y = 50/50 (by mol)

(2) White reflective layer containing 20 g/m² of titanium oxide and 2.0 g/m² of gelatin (3) Light screening layer containing 2.70 g/m² of carbon black and 2.70 g/m² of gelatin (4) Layer containing 0.45 g/m² of the undermentioned magenta DRR compound, 0.10 g/m² of diethyllaurylamide, 0.0074 g/m² of 2,5-di-t-butylhydroquinone, and 0.76 g/m² of gelatin:

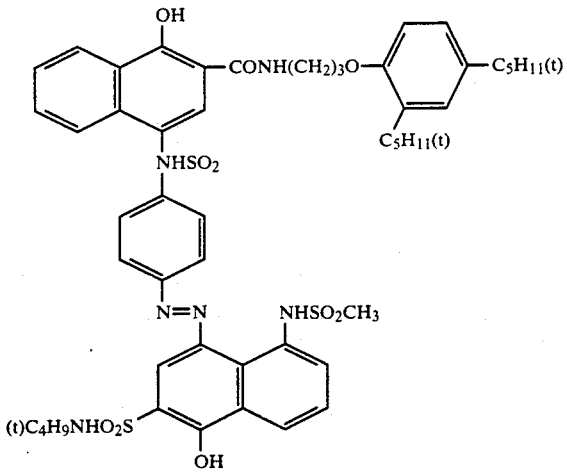

(5) Green-sensitive internal latent image type direct positive silver bromoiodide emulsion layer (silver iodide content: 2 mol %) containing an internal latent image type emulsion (1.4 g/m² as calculated in terms of amount of silver), a green-sensitive sensitizing dye (1.9 mg/m²) and a nucleating agent as shown in Table 6 and sodium 5-pentadecyl-hyydroquinone-2-sulfonate (0.11 g/m²)

(6) Layer containing 0.94 g/m² of gelatin

The light-sensitive element sample Nos. 1 to 8 were then combined with the following elements.

| Processing solution | |
|---|---|
| 1-Phenyl-4-methyl-4-hydroxymethyl-3-pyrazolidone | 10 g |
| Methyl hydroquinone | 0.18 g |
| 5-Methylbenztriazole | 4.0 g |
| Sodium sulfite (anhydride) | 1.0 g |
| Sodium carboxymethylcellulose salt | 40.0 g |
| Carbon black | 150 g |
| Potassium hydroxide (28 wt % aqueous solution) | 200 ml |
| $H_2O$ | 550 ml |

0.8 g of the above described processing solution was packed in some pressure-rupturable vessels.

Cover sheet

A cover sheet was prepared by coating 15 g/m$^2$ of polyacrylic acid (10 wt.% aqueous solution having a viscosity of about 1,000 cp) as an acidic polymer layer (neutralizing layer) on a polyethyleneterephthalate support and 3.8 g/m$^2$ of acetyl cellulose (hydrolysis of 100 g of acetyl cellulose produces 39.4 g of acetyl group) and 0.2 g/m$^2$ of a styrene-maleic anhydride copolymer having a composition (molar) proportion of styrene to maleic anhydride of about 60 / 40 and a molecular weight of about 50,000 as a neutralization timing layer thereon.

Forced deterioration condition

Two sets of the light-sensitive element sample Nos. 1 to 8 were prepared. One of the sets was stored in a refrigerator at a temperature of 5° C., and the other was allowed to stand at a temperature of 35° C. and a relative humidity of 80% over 4 days.

Processing step

The above described cover sheet and the light-sensitive sheets thus obtained were laminated together. The light-sensitive sheets were then exposed to light from the cover sheet side through a color test chart. The above described processing solution was then spread between the cover sheet and the light-sensitive sheets to a thickness of 75 μm by means of a pressure roller. The processing was affected at a temperature of 25° C. After processing, the light-sensitive sheets were then processed using a Macbeth reflection densitometer. After 1 hour, the green density of images formed on the image-receiving layer was measured through the transparent support of the light-sensitive sheets. The results are shown in Table 6.

TABLE 6

| Light-sensitive element sample No. | Nucleating Type | Agent Added amount (mg/m$^2$) | $D^F_{max}$ | $S^F$ | $S^W$ |
|---|---|---|---|---|---|
| 1 (Comparison) | ExZK-1 | 0.1 | 1.70 | 100 | 100 |
| 2 " | Comparative Compound E | 0.5 | 1.50 | x | x |
| 3 (Invention) | Exemplary compound I-1 | 0.1 | 1.93 | 97 | 102 |
| 4 " | Exemplary compound I-2 | 0.1 | 1.95 | 100 | 103 |
| 5 " | Exemplary compound I-18 | 0.1 | 1.90 | 95 | 103 |
| 6 " | Exemplary compound I-23 | 0.1 | 1.94 | 100 | 102 |

x: Unmeasurable
$D^F_{max}$: Maximum density of positive image portion of sample stored in a refrigerator
$S^F$: Relative sensitivity of positive image portion having a density of 0.5 of sample stored in a refrigerator to that of Sample No. 1 as 100
$S^W$: Relative sensitivity of positive image portion having a density of 0.5 of sample allowed to stand at 35° C. and 80% RH over 4 days to that of Sample No. 1 as 100

The above results show that light-sensitive element sample Nos. 3 to 6 comprising the present nucleating agents exhibit a higher $D_{max}$ than light-sensitive element sample No. 1 comprising a prior art nucleating agent in the same amount. After being aged, light-sensitive element sample Nos. 3 to 6 exhibit changes in sensitivity that cause no practical problems than light-sensitive element sample No. 2.

EXAMPLE 7

In order to exemplify the present invention, the following Emulsion X was prepared.

Emulsion X

An aqueous solution of silver nitrate and an aqueous solution of potassium bromide were added to an aqueous solution of gelatin (pH 5.5) of 75° C. containing 20 mg/l of thioether (1,8-dihydroxy-3,6-dithiooctane) at the same time at a constant flow rate with vigorous stirring, while the silver electrode potential was maintained by octahedral grains, in such a manner that silver nitrate was added in an amount of 1/8 mol for 5 minutes. As a result, a monodisperse emulsion of spherical AgBr grains having an average particle diameter of about 0.14 μm was obtained. Sodium thiosulfate and chloroauric acid (tetrahydrate) were added to the emulsion in amounts of 20 mg and 20 mg per 1 mol of silver halide, respectively, to adjust the pH value thereof to 7.5. The emulsion was then subjected to chemical sensitization at a temperature of 75° C. for 80 minutes with vigorous stirring to prepare a core emulsion. An aqueous solution of silver nitrate (containing $\frac{7}{8}$ mol of silver nitrate) and an aqueous solution of potassium bromide were added to the core emulsion at the same time with vigorous stirring for 40 minutes while a silver electrode potential was maintained such that octahedral grains grew so that shells were grown to grains having an average particle diameter of about 0.3 μm, and a monodisperse octahedral core/shell type emulsion was obtained. The emulsion was then washed with water and desalted. After being heated and dissolved, the emulsion was adjusted to pH 6.5. Sodium thiosulfate and chloroauric acid (tetrahydrate) were added to the emulsion in amounts of 5 mg and 5 mg per 1 mol of silver halide, respectively. The emulsion was then subjected to ripening at a temperature of 75° C. over 60 minutes to chemically sensitize the surface of the shells. Eventually, an internal latent image-type monodisperse emulsion of core/shell octahedral grains (i.e., Emulsion X) was obtained. The particle size distribution of the emulsion was measured using an electronmicroscope. As a result, it was found that the average particle diameter was 0.30 μm and the coefficient of variation in particle diameter (average particle diameter×100/standard deviation) was 10%.

A panchromatic sensitizing dye 3,3'-diethyl-9-methyl thiacarbocyanine was added to Emulsion X in an amount of 5 mg per 1 mol of silver halide. Exemplary compounds I-3, I-4, I-20 and I-21 and Comparative compound-G were added to the emulsion as nucleating agents in the amounts shown in Table 7. Compound-D was added to the emulsion as a nucleation accelerator in an amount of $1\times10^{-3}$ mol per 1 mol of silver halide. The emulsion was then coated on a polyethylene terephthalate support in an amount of 2.8 g/m$^2$ as calculated in terms of amount of silver. At the same time, a protective layer comprising gelatin and a film hardener was coated on the coated layer. As a result, a direct positive photographic light-sensitive material sensitive to light up to the red ray was prepared.

The light-sensitive material thus prepared was then exposed to light from a 1-kw tungsten lamp (color temperature: 2,854° K.) sensitometer through a step wedge over 0.1 second. The light-sensitive material was then developed with a Kodak Proster Plus processing solution (pH of developing solution: 10.7) at a temperature of 38° C. over 18 seconds in an automatic developing apparatus (Kodak Proster I Processor). The light-sensitive material was then washed with water, fixed, washed with water, and dried in the same developing apparatus. These specimens samples were then measured for maximum density ($D_{max}$), minimum density ($D_{min}$) and relative sensitivity of direct positive image.

The results are shown in Table 7.

TABLE 7

| Sample No. | Type | Nucleating agent Added amount (mol/Agx mol) | Positive $D_{max}$ | Positive $D_{min}$ | Relative sensitivity (D = 1.2) |
|---|---|---|---|---|---|
| 1 (Comparison) | Comparative Compound-G | $1.0\times10^{-4}$ | 2.20 | 0.08 | 100 |
| 2 (Invention) | Exemplary Compound I-3 | $1.0\times10^{-5}$ | 2.60 | 0.06 | 121 |
| | | $2.0\times10^{-5}$ | 2.70 | 0.06 | 105 |
| | | $3.0\times10^{-5}$ | 2 70 | 0.07 | 110 |
| 3 " | Exemplary Compound I-4 | $1.0\times10^{-5}$ | 2.63 | 0.06 | 123 |
| | | $2.0\times10^{-5}$ | 2.74 | 0.07 | 111 |
| | | $3.0\times10^{-5}$ | 2.72 | 0.07 | 112 |
| 4 " | Exemplary Compound I-20 | $1.0\times10^{-5}$ | 2.55 | 0.05 | 118 |
| | | $2.0\times10^{-5}$ | 2.62 | 0.06 | 109 |
| | | $3.0\times10^{-5}$ | 2.63 | 0.07 | 110 |
| 5 " | Exemplary Compound I-21 | $1.0\times10^{-5}$ | 2.61 | 0.06 | 123 |
| | | $2.0\times10^{-5}$ | 2.72 | 0.06 | 110 |
| | | $3.0\times10^{-5}$ | 2 71 | 0.07 | 113 |

Table 3 shows that Exemplary Compounds I-3, I-4, I-20, I-21 as nucleating agents exhibit higher reversal effects (i.e., reversal performance) and sensitivities than Comparative Compound-G as control nucleating agent, even if the compounds are used in amounts 1/10th that of Comparative Compound-G. That is, these novel nucleating agents exhibit an extremely high nucleation activity.

When these samples were developed with a developing solution whose pH value had been adjusted with an acid to 10.0, they had similarly higher reversal effects.

Comparative Compound-G

-continued

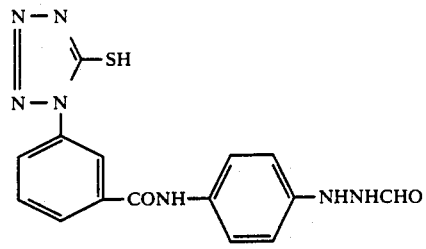

Compound-D

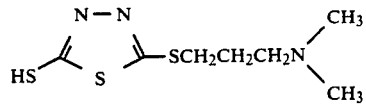

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one hydrophilic colloid layer, at least one of which is a silver halide photographic emulsion layer, wherein at least one of said silver halide emulsion layers or other hydrophilic colloid layers contains a compound represented by formula (I):

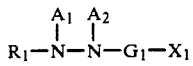

(I)

wherein, $A_1$ and $A_2$ both represent hydrogen atoms or one represents a hydrogen atom and the other a sulfonyl group or an acyl group, $R_1$ represents an aliphatic group, an aromatic group or a heterocyclic group, $G_1$ represents a carbonyl group, a sulfonyl group, a sulfoxy group, a

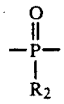

group wherein $R_2$ represents an alkoxyl group or an aryloxy group, a $$-\overset{O}{\overset{\|}{C}}-\overset{O}{\overset{\|}{C}}-$$

group or an iminomethylene group, $X_1$ is represented by formula (a):

$$-L_1-Z_1 \qquad (a)$$

wherein $Z_1$ is —COOH, —OH, —SH or —$NHR_3$ (wherein $R_3$ is a hydrogen atom, an alkyl group, an aryl group, a heterocyclic group, a —$COR_4$ group or a —$SO_2R_4$ group wherein $R_4$ is a hydrogen atom, an alkyl group, an aryl group or a heterocyclic group) and $L_1$ is a divalent organic group whereby $G_1$, $L_1$ and $Z_1$ are able to form a ring structure when $Z_1$ attacks $G_1$ nucleophilically; and at least one of $R_1$ and $X_1$ has a silver halide adsorption accelerating group represented by $Y_1$— $(L_2)l$—(wherein $Y_1$ is a ring-like thioamido group or a nitrogen-containing heterocyclic group, $L_2$ is a divalent linking group, and l is 0 or 1).

2. A silver halide photographic material as in claim 1, wherein the compound represented by formula (I) is contained in the silver halide photographic emulsion layer.

3. A silver halide photographic material as in claim 1, wherein the compound represented by formula (I) is contained in the hydrophilic colloid layer.

4. A silver halide photographic material as in claim 1, wherein both $A_1$ and $A_2$ are hydrogen atoms.

5. A silver halide photographic material as in claim 1, wherein $X_1$ is represented by formula (b):

$$Z_1\text{-}(CR_b^1R_b^2)_m\text{-}\underset{\underset{C}{\|}}{C}\text{-}B \qquad (b)$$

wherein $R_b^1$, $R_b^2$, $R_b^3$, and $R_b^4$, may be identical or different, and represent hydrogen atoms, alkyl groups, alkenyl groups, and aryl groups; B is an atom which is required to complete a 5-membered ring or 6-membered ring; and m and n are 0 and 1 with the proviso that (n+m) is 0 or 1 when $Z_1$ is COOH and is 1 or 2 when $Z_1$ is OH, SH or $NHR_3$.

6. A silver halide photographic material as in claim 5, wherein m is 0 and n is 1.

7. A silver halide photographic material as in claim 6, wherein the ring formed by B is a benzene ring.

8. A silver halide photographic material as in claim 1, wherein $X_1$ is represented by formula (c):

$$\text{-}(\overset{R_c^3}{\overset{|}{N}})_p\text{-}(CR_c^1R_c^2)_q\text{-}Z_1 \qquad (c)$$

wherein $R_c^1$ and $R_c^2$ may be identical or different and are selected from hydrogen atoms, alkyl groups, alkenyl groups, aryl groups, and halogen atoms, $R_c^3$ represents a hydrogen atom, an alkyl group, an alkenyl group or an aryl group, p represents 0 to 1 and q represents an integer of from 1 to 4.

9. A silver halide photographic material as in claim 1, wherein the compound represented by formula (I) is further represented by formula (II):

$$Y_1-(L_2)_l-R_1'-\overset{A_1}{\overset{|}{N}}-\overset{A_2}{\overset{|}{N}}-G_1-X_1 \qquad (II)$$

wherein $R_1'$ is a group from which one of the hydrogen atoms of $R_1$ in formula (I) has been excluded, $Y_1$, $X_2$, $L_2$, l, and $A_1$, $A_2$, $G_1$, and $X_1$ have the same significance as explained for formula (I), with the proviso that at least one of $R_1'$ and $L_2$ is a substituent group which can be dissociated to an anion of a pKa of 6 or greater.

10. A silver halide photographic material as in claim 1, wherein the compound represented by formula (I) is further represented by formula (III):

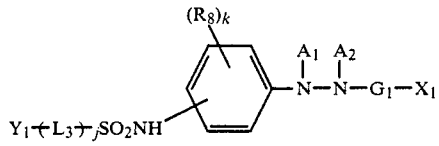

(III)

wherein the $R_8$ groups may be identical or different and are selected from the same groups represented by $R_1$ in formula (I), $L_3$ is a divalent linking group, k represents 0, 1 or 2, and j represents 0 or 1 and $Y_1$, $A_1$, $A_2$, $G_1$, and $X_1$ have the same significance as explained for formula (I).

11. A silver halide photographic material as in claim 1, wherein the compound represented by formula (I) is present in an amount ranging from $1\times10^{-5}$ to $5\times10^{-2}$ mol/mol of silver halide.

12. A silver halide photographic material as in claim 11, wherein the compound represented by formula (I) is present in an amount ranging from $2\times10^{-5}$ to $1\times10^{-2}$ mol/mol of silver halide.

* * * * *